United States Patent [19]

Hall

[11] 4,431,422

[45] Feb. 14, 1984

[54] MARINE HYDRAULIC STEERING SYSTEM CONTROL

[75] Inventor: Charles B. Hall, Ingleside, Ill.

[73] Assignee: Outboard Marine Corporation, Waukegan, Ill.

[21] Appl. No.: 258,874

[22] Filed: Apr. 29, 1981

[51] Int. Cl.[3] ..... B63H 25/22

[52] U.S. Cl. ..... 440/61; 440/53; 114/144 R

[58] Field of Search ..... 244/78, 76 C; 114/144 R, 150, 163; 440/61, 53

[56] References Cited

U.S. PATENT DOCUMENTS

| | | | |
|---|---|---|---|
| 4,088,087 | 5/1978 | Nitta | 114/150 |
| 4,271,780 | 6/1981 | Etoh | 114/144 E |

FOREIGN PATENT DOCUMENTS

| | | | |
|---|---|---|---|
| 1271729 | 4/1972 | United Kingdom . | |
| 612850 | 6/1978 | U.S.S.R. | 114/150 |
| 734063 | 5/1980 | U.S.S.R. | 114/150 |

OTHER PUBLICATIONS

English Translation of USSR #734063.

*Primary Examiner*—Trygve M. Blix
*Assistant Examiner*—Thomas J. Brahan
*Attorney, Agent, or Firm*—Michael, Best & Friedrich

[57] ABSTRACT

Disclosed herein is a hydraulic control unit for a marine installation comprising a helm station including a pump comprising first and second pump discharge ports, which pump is selectively and alternatively operable to deliver fluid under pressure from the first and second pump discharge ports, a plurality of steerable marine propulsion units, a plurality of corresponding hydraulic steering cylinders respectively connected to each of the propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of each steering cylinder except the last steering cylinder with the first port of the following steering cylinder, which hydraulic control unit includes a hydraulic circuit adapted for communication between the first pump discharge port and the first steering cylinder first port and between the second pump discharge port and the last steering cylinder second port and with a tie line and operable, during the presence of fluid under pressure at one of the first and second discharge ports, and in response to the absence of fluid under pressure in the tie line, for preventing steering movement of the other of the first and last propulsion units, and operable, when the steerable propulsion units are in nonangularly aligned steering positions, for locating the steerable propulsion units in angularly aligned positions.

75 Claims, 11 Drawing Figures

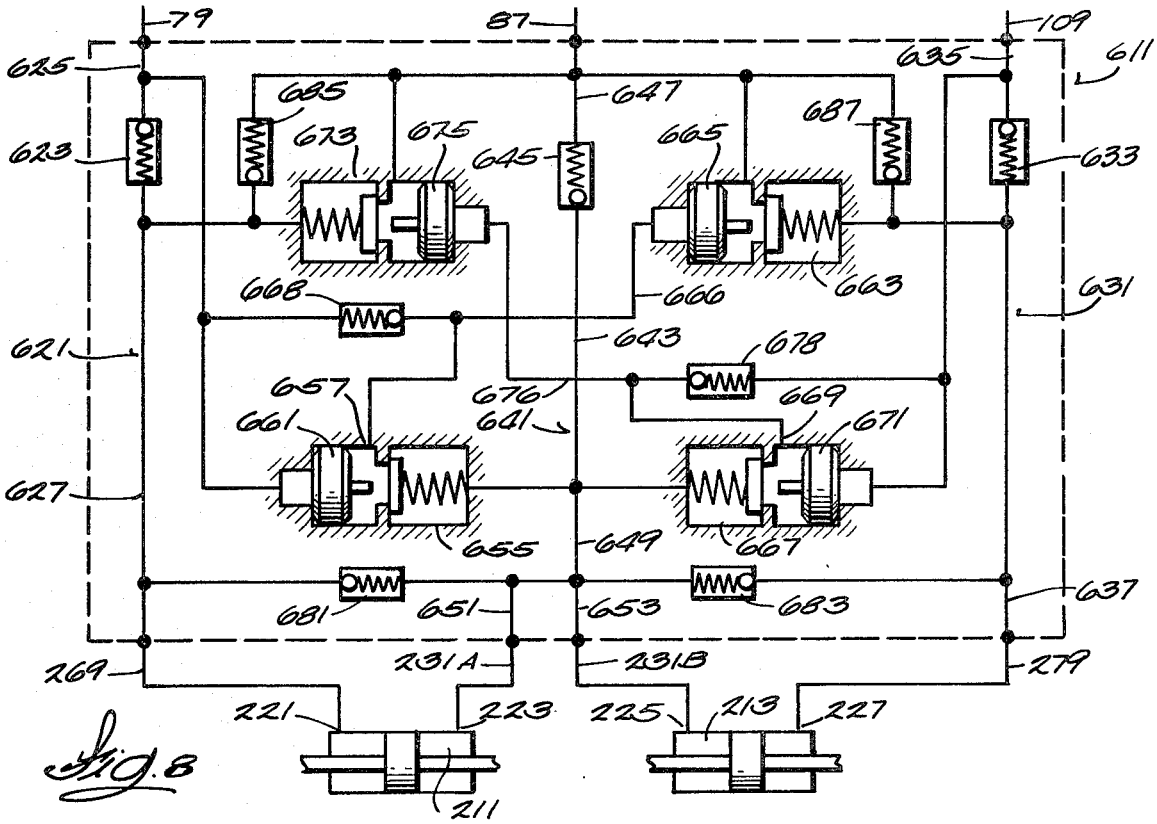
Fig. 8
Fig. 9
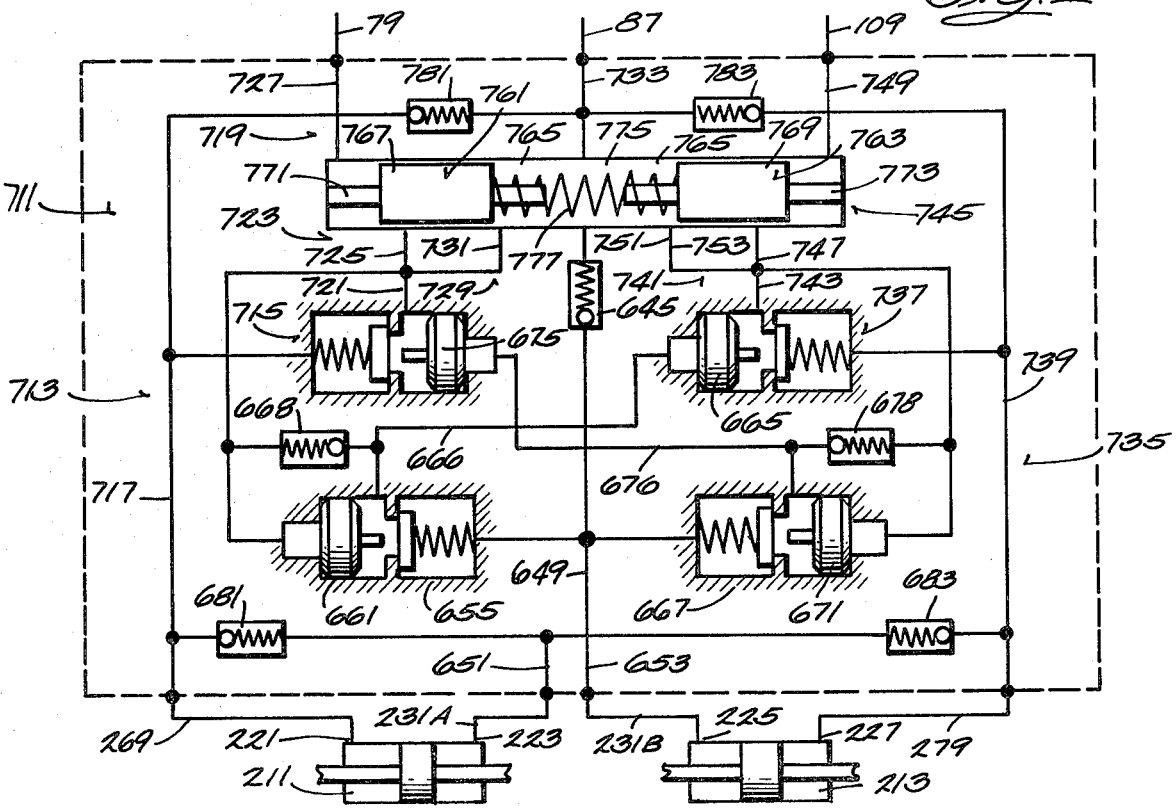

MARINE HYDRAULIC STEERING SYSTEM CONTROL

RELATED APPLICATION

Reference is hereby made to the Hall, et al. application, Ser. No. 173,158 filed July 28, 1980, now U.S. Pat. No. 4,373,920.

BACKGROUND OF THE INVENTION

The invention relates generally to marine propulsion devices and, more particularly, to steering systems for marine propulsion devices. Still more paricularly the invention is directed to control valving interposed between a conventional two or three conduit helm steering station and two or more conventional marine propulsion devices each including a two-way hydraulic steering cylinder having, at the ends thereof, opposed ports.

Attention is directed to the prior Harrison U.S. Pat. No. 3,738,228, issued June 12, 1973 and to the Wood U.S. Pat. No. 4,092,905, issued June 6, 1978, which patents disclose prior art steering helms.

Attention is also directed to the prior Wood U.S. Pat. No. 3,576,192 issued Apr. 27, 1971, and U.S. Pat. No. 3,908,687 issued Sept. 30, 1975, which patents disclose control valves for interposition between a helm station and a marine propulsion device.

Attention is also directed to the prior art marine installations described hereinafter under the heading "General Description".

SUMMARY OF THE INVENTION

The invention provides a hydraulic control unit for a marine installation comprising a helm station including a pump comprising first and second pump discharge ports, and means for selectively and alternatively delivering fluid under pressure from the pump to the first and second pump discharge ports, first and second steerable marine propulsion units, first and second hydraulic steering cylinders respectively connected to the steerable first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, which hydraulic control unit includes means which is adapted for communication between the first pump discharge port and the first steering cylinder first port and between the second pump discharge port and the second steering cylinder second port and with the tie line and which is operable, during the presence of fluid under pressure at one of the first and second discharge ports, and in response to the absence of fluid under pressure in the tie line, for preventing steering movement of the other of the first and second propulsion units. In addition, the invention also provides a marine installation including the control unit described immediately above.

The invention also provides a hydraulic control unit for a marine propulsion installation comprising a helm station including a pump comprising first and second pump discharge ports, and means for selectively and alternatively delivering fluid under pressure from the pump to the first and second pump discharge ports, first and second steerable marine propulsion units, first and second hydraulic steering cylinders respectively connected to the steerable first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, which hydraulic control unit includes means which is adapted for communication between the first pump discharge port and the first steering cylinder first port and between the second pump discharge port and the second steering cylinder second port and with the tie line and which is operable, when the steerable propulsion units are in nonangularly aligned steering positions, for locating the steerable porpulsion units in aligned angular positions. In addition, the invention also provides a marine installation including the control unit described immediately above.

The invention also provides a hydraulic control unit for a marine installation comprising a helm station including a pump comprising first and second pump discharge ports, and means for selectively and alternatively delivering fluid under pressure from the pump to the first and second pump discharge ports, first and second steerable marine propulsion units, first and second hydraulic steering cylinders respectively connected to the steerable first and second propulsion units and including respective first ports which, when subject to fluid under pressure, tend to steer the propulsion units in one direction and including respective second ports which, when subject to fluid under pressure, tend to steer the propulsion unit in the opposite direction, and a hydraulic tie line connecting the second port of the first steering cylinder with the first port of the second steering cylinder, which hydraulic control unit includes means which is adapted for communication between the first pump discharge port and the first steering cylinder first port and between the second pump discharge port and the second steering cylinder second port and with the tie line, which is operable, during the presence of fluid under pressure at one of the first and second discharge ports, and in response to the absence of fluid under pressure in the tie line, for preventing steering movement of the other of the first and second propulsion units, and which operable, when the steerable propulsion units are in nonangularly aligned steering positions, for locating the steerable propulsion units in aligned angular positions. In addition, the invention also provides a marine installation including the control unit described immediately above.

The invention also provides a hydraulic control unit for a marine installation comprising a helm station comprising a pump including first and second pump discharge ports, and means for selectively and alternatively delivering fluid under pressure from the pump to the first and second pump discharge ports, first and second, third, and fourth steerable propulsion units, first, second, third, and fourth hydraulic steering cylinders respectively connected to the first, second, third, and fourth propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, a second tie line connecting the second steering cylinder second port and the third steering cylinder first port, and a third tie line connecting the third steering cylinder second port and the fourth steering cylinder first port, which hydraulic control unit includes means which is adapted for communication between the first pump discharge port and the first steering cylinder first port and between the second pump discharge port and the second steering cylinder second port and with one of the tie lines and which is operable, during the presence of fluid under pressure at one of the first and second discharge ports, and in response to the absence of fluid under pressure in the one tie line, for preventing steering movement of the other of the first and fourth propulsion units. In addition, the invention also provides a marine installation including the control unit described immediately above.

The invention also provides a hydraulic control unit for a marine installation comprising a helm station including a sump, a pump communicating with the sump and including first and second pump discharge ports, and means for selectively and alternatively delivering fluid under pressure from the pump to the first and second pump discharge ports, first, second, third, and fourth steerable propulsion units, first, second, third, and fourth hydraulic steering cylinders respectively connected to the first, second, third, and fourth propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, a second tie line connecting the second steering cylinder second port and the third steering cylinder first port, and a third tie line connecting the third steering cylinder second port and the fourth steering cylinder first port, which hydraulic control unit includes means which is adapted for communication between the first pump discharge port and the first steering cylinder first port and between the second pump discharge port and the fourth steering cylinder second port and with one of the tie lines and which is operable, when the steerable propulsion units are in nonangularly aligned steering positions, for locating the steerable propulsion units in angularly aligned positions. In addition, the invention also provides a marine installation including the control unit described immediately above.

The invention also provides a hydraulic control unit for a marine installation comprising a helm station comprising a pump including first and second pump discharge ports, and means for selectively and alternatively delivering fluid under pressure from the pump to the first and second pump discharge ports, first and second, third, and fourth steerable marine propulsion units, first, second, third, and fourth hydraulic steering cylinders respectively connected to the first, second, third, and fourth propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, a second tie line connecting the second steering cylinder second port and the third steering cylinder first port, and a third tie line connecting the third steering cylinder second port and the fourth steering cylinder first port, which hydraulic control unit includes means which is adapted for communication between the first pump discharge port and the first steering cylinder first port and between the second pump discharge port and the second steering cylinder second port and with one of the tie lines, which is operable, during the presence of fluid under pressure at one of the first and second discharge ports, and in response to the absence of fluid under pressure in the one tie line, for preventing steering movement of the other of the first and fourth propulsion units, which is operable, when the steerable propulsion units are in nonangularly aligned steering positions, for locating the steerable propulsion units in angularly aligned position. In addition, the invention also provides a marine installation including the control unit described immediately above.

Other features and advantages of the embodiments of the invention will become known by reference to the following general description, claims and appended drawings.

IN THE DRAWINGS

FIG. 7 is a fragmentary and diagrammatic view of a third marine propulsion installation incorporating various of the features of the invention.

FIG. 8 is a fragmentary and diagrammatic view of a fourth marine propulsion installation incorporating various of the features of the invention.

FIG. 9 is a fragmentary and diagrammatic view of a fifth marine propulsion installation incorporating various of the features of the invention.

Figure 1:
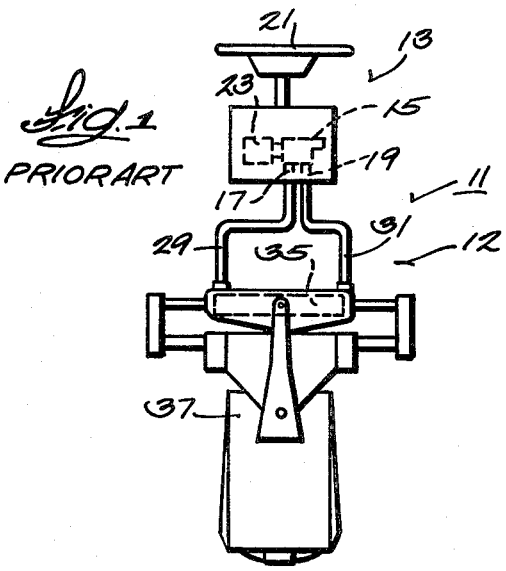
Fig. 1 PRIOR ART
FIG. 1 is a fragmentary and diagrammatic view of a prior art marine propulsion installation.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown fragmentarily and schematically in FIG. 1 is a prior art marine propulsion installation 11 including a steering system 12 comprising a helm station 13 including a hydraulic pump 15 having first and second discharge ports 17 and 19, together with a steering wheel 21 which operates the pump 15 to deliver fluid under pressure from a selected one of the first and second pump discharge ports 17 and 19, depending upon the direction of the rotation of the steering wheel 21. Also included in the helm station 13 is a fluid reservoir or sump 23 which communicates with the pump 15. The first and second discharge ports 17 and 19 of the helm station 13 are connected by respective conduits 29 and 31 with the opposite ends of a steering cylinder piston assembly 35 which is connected to a steerable propulsion unit 37 for controlling steering movement thereof. Accordingly, supply of fluid under pressure through one of the conduits 29 and 31 effects actuation of the steering cylinder-piston assembly 35 to provide propulsion unit steering in one direction, and supply of fluid under pressure in the other of the conduits 29 and 31 effects actuation of the cylinder-piston assembly 35 to provide propulsion unit steering in the opposite direction. Such prior art installations are referred to as two-line steering systems.

Figure 2:
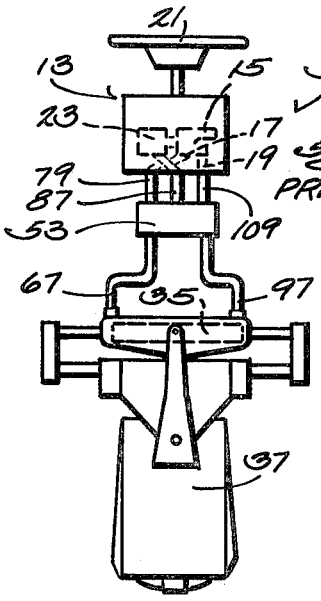
Fig. 2 PRIOR ART
FIG. 2 is a fragmentary and diagrammatic view of a second prior art marine propulsion installation.

Shown fragmentarily and schematically in FIG. 2 is another prior art marine installation 51 in which steering movements originated at or by the propulsion unit are prevented. The installation 51 shown in FIG. 2 includes a helm station 13 as already generally explained in regard to FIG. 1. The marine installation 51 shown in FIG. 2 also includes a single cylinder-piston assembly 35 operable to effect steering of a propulsion unit 37. Located between the helm station 13 and the cylinder-piston assembly 35 is an auxiliary no-back steering valve assembly 53 which is operative to prevent steering caused by forces which are generated at or by the propulsion unit 37.

Figure 3:
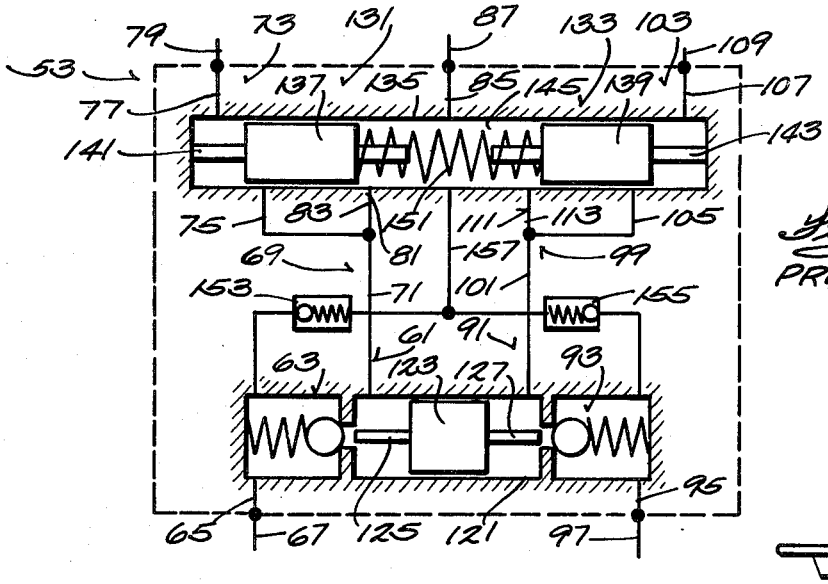
Fig. 3 PRIOR ART
FIG. 3 is a diagrammatic view of a control valve incorporated in the marine propulsion installation shown in FIG. 2.

More particularly, the valve assembly 53 is shown in greater detail in FIG. 3 and includes a first fluid line 61 including a normally closed, first check valve 63 dividing the first line 61 into a downstream portion 65 communicating (See FIG. 2) through a conduit 67 with one end of the steering cylinder-piston assembly 35 and an upstream portion 69 having a common brance 71, a supply branch 73 including a downstream part 75 communicating with the common branch 71, and an upstream part 77 communicating through a conduit 79 (See FIG. 2) with the first pump discharge port 17, and a return branch 81 including an upstream part 83 communicating with the common branch 71 and a downstream part 85 communicating (See FIG. 2) through a conduit 87 with the sump 23 at the helm station 13.

The no-back steering valve assembly 53 also includes a second fluid line 91 including a normally closed, second check valve 93 dividing the second line 91 into a downstream portion 95 communicating (See FIG. 2) through a conduit 97 with the other end of the steering cylinder-piston assembly 35, and an upstream portion 99 having a common branch 101, a supply branch 103 including a downstream part 105 communicating with the common branch 101, and an upstream branch 107 communicating (See FIG. 2) through a conduit 109 with the second pump discharge port 19, and a return branch 111 including an upstream part 113 communicating with the common branch 101 and a downstream part formed in common with the downstream part 85 of the return branch 81 of the upstream portion of the first fluid line 61 and which communicates (See FIG. 2) through the conduit 87 with the sump 23.

The no-back steering valve assembly 53 also includes means responsive to fluid under pressure in the upstream portion of the first line 61 for opening the second check valve 93 and response to fluid pressure in the upstream portion of the second line 91 for opening the first check valve 63. While various arrangements can be employed, in the illustrated prior construction, such means comprises a control cylinder 121 which, at its opposite ends, respectively communicates with the common branches 71 and 101 of the upstream portions of the first and second fluid lines 61 and 91, together with a piston 123 which is located centrally in the control cylinder 121 and which, at its opposite ends, include respective projections 125 and 127 adapted to engage the first and second check valves 63 and 93 for opening thereof in response to the presence of fluid under pressure in the opposite one of the first and second fluid lines 61 and 91.

Means are also provided, with respect to each of the first and second fluid lines 61 and 91, for selectively and alternatively permitting fluid flow in one of the supply and return branches while preventing flow in the other of the supply and return branches. While various other arrangements can be employed, in the illustrated construction, such means includes a first shuttle valve 131 operable selectively, in a first mode and in response to fluid under pressure in the upstream part 77 of the first line supply branch 73, to permit fluid flow from the upstream part 77 to the downstream part 75 of the first line supply branch 73 and to prevent fluid flow in the first line return branch 81, and in a second mode and in response to the absence of fluid under pressure in the upstream part 77 of the first line supply branch 73, to permit fluid flow from the upstream part 83 to the downstream part 85 of the first line return branch 81, and to prevent fluid flow through the first line supply branch 73.

Additionally, the means for selectively and alternately permitting fluid flow in the supply and return branches includes a second shuttle valve 133 operable, in a first mode and in response to fluid under pressure in the upstream part 107 of the second line supply branch 103, to permit fluid flow from the upstream part 107 to the downstream part 105 of the second line supply branch 103 and to prevent fluid flow in the second line return branch 111 and, in a second mode and in response to the absence of fluid under pressure in the upstream part 107 of the second line supply branch 103, to permit fluid flow from the upstream part 113 to the downstream part 85 of the second line return branch 111 and to prevent fluid flow through the second line supply branch 103.

In the illustrated construction, the shuttle valves 131 and 133 are provided by a common cylinder 135 and respective first and second pistons 137 and 139 which are identically constructed, which are located in axially spaced relation in the cylinder 135, and which respectively include, at their remote ends, reduced diameter extensions 141 and 143 adapted respectively to engage the adjacent ends of the cylinder 135 so as to respectively locate the pistons 137 and 139 in positions so that the cylinder ends communicate with the upstream parts 77 and 107 of the supply branches 73 and 103 of the first and second lines 61 and 91, respectively, so that the downstream parts 75 and 105 of the supply branches 73 and 103 of the first and second fluid lines 61 and 91 are respectively closed by the pistons 137 and 139, and so that the upstream parts 83 and 113 of the return branches 81 and 111 of the first and second fluid lines 61 and 91 communicate with the area 145 which is located within the cylinder 135 between the pistons 137 and 139, and which communicates with the downstream part 85 of the return branches 81 and 111 of the first and second fluid lines 61 and 91.

Preferably, as shown in FIG. 3, a biasing spring 151 is located in the cylinder 135 and between the pistons 137 and 139 so that, in the absence of fluid under pressure at one of the ends of the cylinder 135, the pistons 137 and 139 are located with the extensions 141 and 143 in engagement with the adjacent ends of the cylinder 135 so as thereby to prevent fluid flow in the supply branches 73 and 103 and to permit fluid flow in the return branches 81 and 111. As is apparent, the presence of fluid under pressure at one of the ends of the cylinder 135 will cause displacement of the adjacent one of the pistons 137 and 139 against the action of the spring 151 to close the adjacent one of the return branches 81 and 111 and to open the adjacent one of the supply branches 73 and 103.

Because the check valves 63 and 93 are biased closed in the absence of fluid under pressure in the common branches 71 and 101 of the first and second fluid lines 61 and 91, means are provided for relieving excessive pressure which may occur in the downstream portions 65 and 95 of the first and second fluid lines 61 and 91. While various arrangements can be employed, in the illustrated construction, such means comprises first and second pressure relief valves 153 and 155 which communicate respectively with the downstream portions 65 and 95 of the first and second fluid lines 61 and 91 and with a third common duct or line 157 which communicates through the central cylinder area 145, and through the conduit 87 with the sump 23 at the helm station 13. The pressure relief valves 153 and 155 are regulating relief valves which bleed excess pressures, while maintaining a given pressure upstream of the valve. Such prior art arrangements which are shown in FIGS. 2 and 3 are sometimes referred to as three-line steering system.

Figure 4:
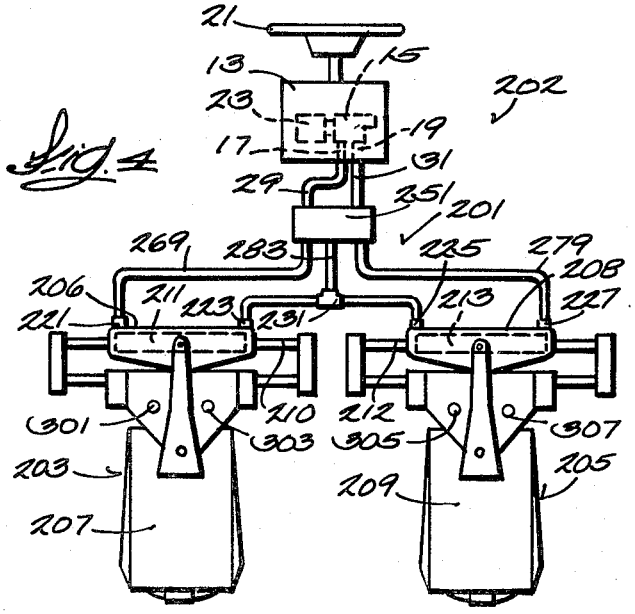
FIG. 4 is a fragmentary and diagrammatic view of a first marine propulsion installation which embodies various of the features of the invention.

Shown fragmentarily and schematically in FIG. 4 is a marine installation comprising a steering system 202 which includes a prior art helm station 13 such as disclosed in connection with FIG. 1 and which is adapted to control steering activity of first and second marine propulsion devices 203 and 205 which respectively include first and second propulsion units 207 and 209 which are connected to and steerable in response to action of respective first and second steering cylinder-piston assemblies 211 and 213. The first steering cylinder-piston assembly 211 includes opposed first and second ports 221 and 223 and the second steering cylinder-piston assembly 213 includes opposed first and second ports 225 and 227. As shown, the second port 223 of the first steering cylinder-piston assembly 211 is hydraulically connected by a tie line 231 to the first port 225 of the second cylinder-piston assembly 213.

The illustrated hydraulic cylinder-piston assemblies 211 and 213 include respective hydraulic cylinders 206 and 208 which are movable left and right on respective first and second rods 210 and 212 fixed against lateral movement and which are respectively connected to the propulsion units 207 and 209 such that movement of the hydraulic cylinders 206 and 208 on the rods 210 and 212 causes associated steering movement of the respective propulsion units 207 and 209. The specific construction of the arrangement is more fully disclosed in U.S. Application, Ser. No. 173,158, filed July 28, 1980. Other steering arrangements utilizing two-way hydraulic cylinders can also be employed.

Figure 5:
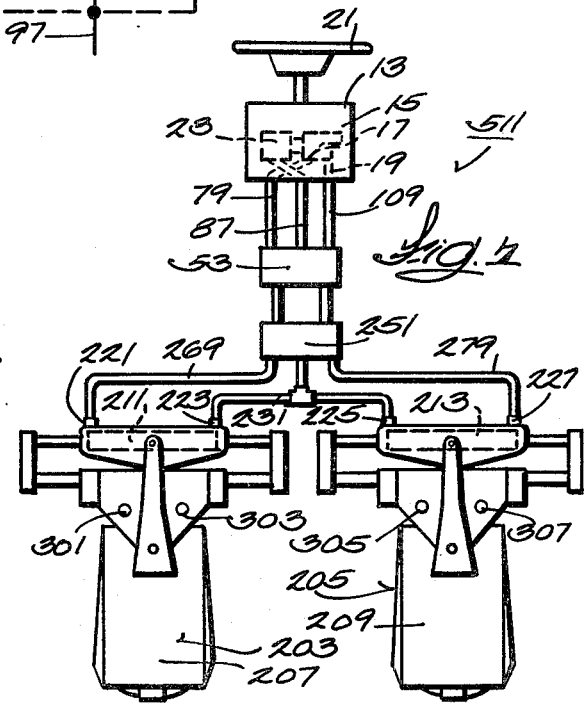
FIG. 5 is a diagrammatic view of a control unit incorporated in the marine propulsion installation shown in FIG. 4.
Figure 5:
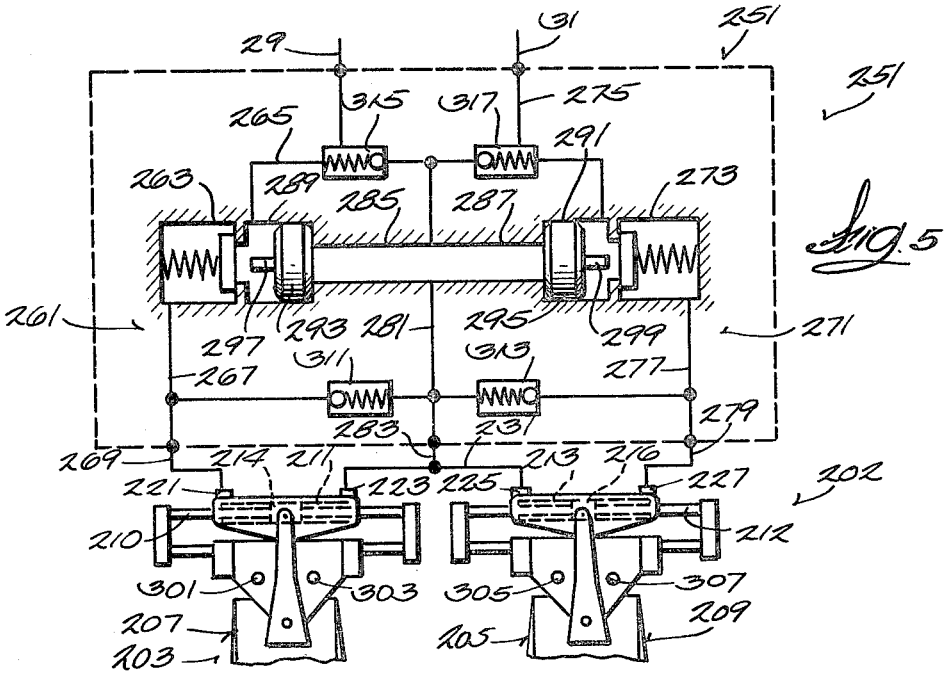

Interconnected between the helm station 13 and the steering cylinder-piston 211 and 213 is a control unit 251 which is shown best in FIG. 5 and which includes means operable, during the presence of fluid under pressure at one of the first and second discharge ports 17 and 19, and in response to the absence of fluid under pressure in the tie line 231, for preventing steering movement of the other of the first and second propulsion units 207 and 209, and means operable, when the steerable propulsion units 207 and 209 are in nonangularly aligned steering positions, for locating the steerable propulsion units 207 and 209 in angularly aligned positions.

The means operable, during the presence of fluid under pressure at one of the first and second discharge ports 17 and 19, and in response to the absence of fluid under pressure in the tie line 231, for preventing steering movement of the other of the first and second propulsion units 207 and 209, comprises, as shown in FIG. 5, a first fluid line 261 including a first one way normally closed check valve 263 which selectively operates to supply and return hydraulic fluid between (see FIG. 4) the first pump discharge port 17 and the steering cylinder port 221, which divides the first fluid line 261 into an upstream portion 265 connected (see FIG. 4) through the conduit 29 to the first pump discharge port 17 and a downstream portion 267 connected (see FIG. 4) through a conduit 269 to the first port 221 of the steering cylinder 211 of the first marine porpulsion device 203.

The control unit 251 further includes a second fluid line 271 including a second normally closed check valve 273 which selectively operates to supply and return hydraulic fluid between (see FIG. 4) the second pump discharge port 19 and the second port 227 of the hydraulic steering cylinder 213 of the second marine propulsion device 205 and which divides the second fluid line 271 into an upstream portion 275 connected (see FIG. 4) through the conduit 31 to the second pump discharge port 19 and a downstream portion 277 connected (see FIG. 4) through a conduit 279 to the second port 227 of the hydraulic steering cylinder 213 of the second marine propulsion device 205.

It is noted that because the check valves 263 and 273 are normally biased closed and therefore remain closed in the absence of fluid under pressure in the upstream portions 265 and 275 of the first and second fluid lines 261 and 271, the means operable, during the presence of fluid under pressure at one of the first and second discharge ports 17 and 19, and in response to the absence of fluid under pressure in the tie line 231, for preventing steering movement of the other of the first and second propulsion units 207 and 209 also includes means for selectively opening the check valves 263 and 273 to permit return fluid flow from one of the downstream steering cylinders 211 and 213 to the sump 23 in response to the presence of positive pressure in the tie line 231. Accordingly, in the absence of positive pressure in the tie line 231, the downstream or return one of the check valves 263 and 273 will remain closed until the fluid supply line provides sufficient fluid under pressure to create a positive pressure in the tie line.

Still more specifically, the means for selectively opening the check valves 263 and 273 in response to the presence of fluid under pressure in the tie line 231 includes (see FIG. 5) a third fluid line 281 which communicates through a conduit 283 with the tie line 231 and which communicates through branch lines 285 and 287 with respective first and second control cylinders 289 and 291 which respectively include first and second control pistons 293 and 295 having respective extensions 297 and 299 for respective engagement with the first and second check valves 263 and 273 for opening thereof in response to a pressure in the tie line 231 greater than the pressure in the upstream portion of the one of the first and second lines 261 and 271 which serves as the return line.

Thus, when the first line 261 serves as the supply line, and when positive pressure is absent in the tie line 231, i.e., during the presence of a vacuum condition in the tie line 231, the second check valve 273 in the second or return line 271 will remain closed until the fluid supply through the first or supply line 261 develops a positive pressure in the tie line 231. Such development of positive pressure in the tie line 231 serves to cause the second control piston 295 to open the second check valve 273 in the second or return line 271, thereby permitting return flow from the second steering cylinder 213 through the second or return line 271.

Operation of the control unit 251 when the second line 271 serves as the supply line is similar to that just described except that positive pressure in the tie line 231 causes the first control piston 293 to open the first check valve 263 in the first line 261 which serves as the return line.

The means operable, when the steerable propulsion units 207 and 209 are in nonangularly aligned steering positions, for locating the steerable propulsion units 207 and 209 in angularly aligned positions includes employment of mechanical stops for limiting steering movement in opposite directions. Such stops can be provided by various arrangements, as for instances, port and starboard stops 301 and 303 on the marine propulsion device 203 and port and starboard stops 305 and 307 on the marine propulsion device 205 (See FIG. 4), or by engagement of the ends of the steering cylinders 211 and 213 with the pistons 214 and 216 respectively housed therein, or by other means to limit propulsion unit movement.

When propulsion unit steering movement is limited by reason of engagement by either the port or starboard stops, the propulsion units 207 and 209 will be located in corresponding angular positions and the fluid volumes at opposite sides of the steering cylinder pistons will be correct for causing simultaneous propulsion unit steering with the propulsion units 207 and 209 located in corresponding angular positions.

The means operable, when the steerable propulsion units 207 and 209 are in nonangularly aligned steering positions, for locating the steerable propulsion units 207 and 209 in angularly aligned positions also includes, as also shown in FIG. 5, first and second one way pressure relief valves 311 and 313 which communicate respectively between the downstream portions 267 and 277 of the first and second lines 261 and 271 and the third line 281 and which, in response to the presence of fluid under pressure above a predetermined level in the first and second lines 261 and 271, permit fluid flow from the downstream portions 267 and 277 to the tie line 231. In addition, the means operable, when the steerable propulsion units 207 and 209 are in nonangularly aligned steering positions, for locating the steerable propulsion units 207 and 209 in angularly aligned positions further includes third and fourth pressure relief valves 315 and 317 which communicate between the third line 281 and the upstream portions 265 and 275 of the first and second lines 261 and 271 and which, in response to the presence of fluid under pressure in the third line 281 above a predetermined level, permit fluid flow from the third line 281 to the upstream portions 265 and 275 of the first and second lines 261 and 271 for return to the helm station sump 23. The pressure relief valves 311, 313, 315, and 317 are regulating relief valves which bleed excess pressure, while maintaining a given pressure upstream of the valve.

Thus, if fluid under pressure is supplied to the first line 261 so as to cause counter-clockwise propulsion unit steering in response to steering piston movement to the left in FIGS. 4 and 5 and the second propulsion unit 209 arrives at the stop 305 without the first propulsion unit 207 encountering the stop 301, the build-up of pressure in the tie line 231 and the third line 281 will open the relief valve 317 permitting flow from the steering cylinder 211 and continued movement of the first propulsion unit 209 until arrival at the stop 301.

If the first propulsion unit 207 contacts the stop 301 first, the build-up of pressure in the downstream portion 267 of the first supply line 261 will open the relief valve 311 permitting flow of fluid under pressure to the third line 281 and then to the tie line 231 and to the second steering cylinder 213 so as to effect continuation of steering movement of the second propulsion unit 209 until arrival at the stop 305.

In a similar manner when the second line 271 serves as the supply line so as to cause clockwise propulsion unit steering movement FIGS. 4 and 5, the pressure relief valves 313 and 315 operate to facilitate location of the propulsion units 207 and 209 against their respective stops 303 and 307 and therefore in corresponding angular position so as thereby to facilitate subsequent steering action with the propulsion units 207 and 209 in corresponding angular location. Thus, when the propulsion unit 209 is located against the stop 307, the pressure relief valve 313 opens to provide a path for supplying fluid to the steering cylinder 211.

Similarly, when the second line 271 serves as the supply line, and the propulsion unit 207 arrives at the stop 303, the pressure relief valve 315 opens to provide a path for returning fluid to the helm station 13 through the first line 261.

Figure 6:
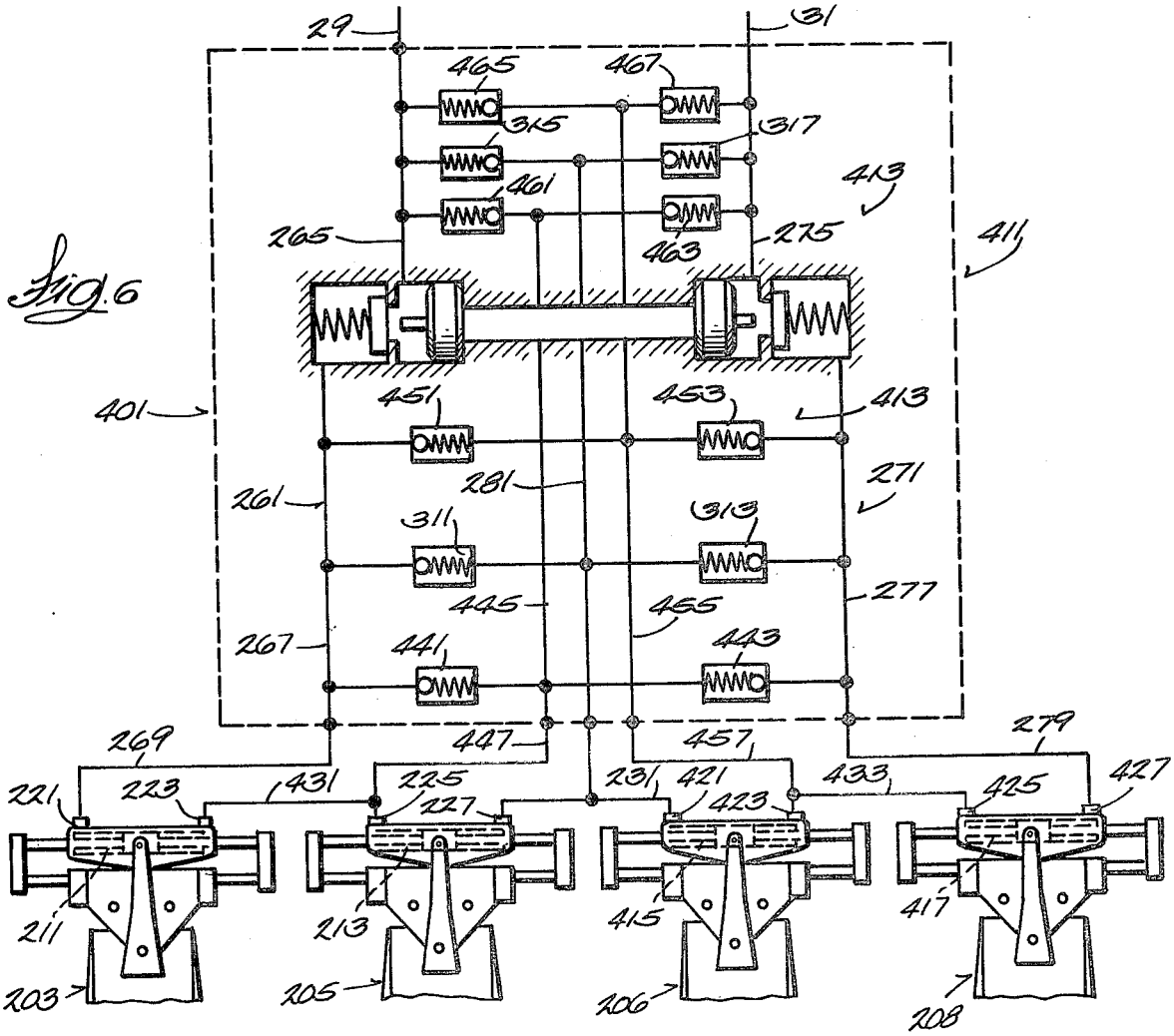
FIG. 6 is a fragmentary and diagrammatic view of a second marine propulsion installation incorporating various of the features of the invention.

Shown fragmentarily and schematically in FIG. 6 is another marine installation 401 including a steering system 411 comprising a control unit 413 which is adapted for interposition between a helm station 13, such as shown in FIG. 1, and a plurality of marine propulsion devices 203, 205, 206 and 208. Various of the steering system components which are generally identical to the components of the steering system 202 shown in FIGS. 4 and 5 will not again be described and are identified in the drawings by the same numerals as used with respect to the corresponding components of the systems shown in FIGS. 1, 4 and 5.

The steering system 411 differs primarily from the steering system of FIGS. 1, 4, and 5 by the addition of third and fourth marine propulsion devices 206 and 208 which respectively include third and fourth steering cylinders 415 and 417, respectively. The third steering cylinder 415 includes opposed first and second ports 421 and 423 and the fourth steering cylinder 417 includes opposed first and second ports 425 and 427. In the steering system shown in FIG. 6, the second port 223 of the first steering cylinder 211 is connected by a first or left hydraulic tie line 431 to the first port 225 of the second steering cylinder 213, the second port 227 of the second steering cylinder 213 is connected by a second or central tie lines 231 to the first port 421 of the third hydraulic steering cylinder 457, and the second port 423 of the third steering cylinder 415 is connected by a third or right hydraulic tie line 433 to the first port 425 of the fourth steering cylinder 417.

As in the embodiment of FIG. 6, the control unit 413 include means operable, during the presence of fluid under pressure at one of the first and second discharge ports 17 and 19, and in response to the absence of fluid under pressure in one of the tie lines 231, 431, and 433, for preventing steering movement of the other of the first and fourth propulsion units, and means operable, when the steerable propulsion units are in nonangularly aligned steering positions, for locating the steerable propulsion units in angularly aligned positions.

More particularly, in the arrangement shown in FIG. 6, the center tie line 231, connecting the second and third steering cylinders 213 and 415, is connected to the third line 281 in the control unit 413. In addition, the means for locating the steerable propulsion devices in angularly aligned positions includes pressure relief valves 441 and 443 which communicate respectively with the downstream portions 267 and 277 of the first and second lines 261 and 271 and with a fourth line 445 communicating with a conduit 447 which, in turn, communicates with the left or first tie line 431 between the first and second steering cylinders 211 and 213. Additional pressure relief valves 451 and 453 communicate respectively with the downstream portions 267 and 277 of the first and second lines 261 and 271 and with a fifth line 455 communicating with a conduit 457 which, in turn, communicates with the right or third tie line 433 between the third and fourth steering cylinders 415 and 417. Still further in addition, further additional pressure relief valves 461 and 463 communicate between the fourth line 445 and the upstream portions 265 and 275 of the first and second lines 261 and 271 and further pressure relief valves 465 and 467 communicate between the fifth line 455 and the upstream portions 265 and 275 of the first and second lines 261 and 271. The pressure relief valves 441, 443, 451, 453, 461, 463, 465 and 467 are regulating relief valves which bleed excess pressure, while maintaining a given pressure upstream of the valve.

Shown fragmentarily and schematically in FIG. 7 is another marine propulsion installation 511 which is adapted for interposition in a steering system between the assembly of a helm station 13 and valve assembly 53, such as shown in FIG. 2, and a pair of marine propulsion units 207 and 209 such as shown in FIG. 4. The marine installation 511 also includes the control unit 251 which is shown in FIG. 5 and which is connected intermediate the no back steering valve assembly 53 shown in FIGS. 2 and 3 and the first and second steering cylinders 211 and 213 associated with the first and second marine propulsion units 207 and 209.

Shown fragmentarily and schematically in FIG. 8 is an integrated control unit 611 which incorporates the features of the prior art no-back steering valve assembly 53 and the control unit 251 and which is adapted for interposition between a helm station 13, such as shown in FIG. 2, and a pair of marine propulsion units, such as shown in FIGS. 4 and 7. More particularly, the control unit 611 includes means operable, during the presence of fluid under pressure at one of the pump first and second discharge ports 17 and 19, and in response to the absence of fluid under pressure in the tie line, for preventing steering movement of the other of the first and second propulsion units 203 and 205, and means operable, when the steerable propulsion units 207 and 209 are in nonangularly aligned steering positions, for locating the steerable propulsion units 207 and 209 in angularly aligned positions. Still more particularly, the control unit 611 includes, as shown in FIG. 8, a first fluid line 621 including a first one-way, normally closed check valve 623 which divides the first fluid line 621 into an upstream portion 625 adapted to be connected through the conduit 79 to the first pump discharge port 17 of the helm station 13 shown in FIG. 2 and a downstream portion 627 adapted to be connected through the conduit 269 to the first port 221 of the steering cylinder 211 of the first marine propulsion device 203 and which operates to permit hydraulic fluid flow from the upstream portion 625 to the downstream portion 627 and to prevent hydraulic fluid flow from the downstream portion 627 to the upstream portion 625.

The control unit 611 further includes a second fluid line 631 including a second one-way, normally closed check valve 633 which divides the second fluid line 631 into an upstream portion 635 adapted to be connected through the conduit 109 to the second pump discharge port 19 of the helm station 13 shown in FIG. 2 and a downstream portion 637 adapted to be connected (See FIG. 4) through the conduit 279 to the second port 227 of the hydraulic steering cylinder 213 of the second marine propulsion device 205 and which operates to permit hydraulic fluid flow from the upstream portion 635 to the downstream portion 637 and to prevent hydraulic fluid flow from the downstream portion 637 to the upstream portion 635.

The control unit 611 further includes a third fluid line 641 which comprises a common portion 643 including a first one-way pressure relief valve 645 which divides the common portion 643 into a downstream part 647 communicating through the conduit 87 with the sump 23 of the helm station 13 shown in FIG. 2, and an upstream part 649. The first pressure relief valve 645 operates to relieve excessive pressure from the upstream part 649 of the common portion 643 of the third fluid line 641 whenever the pressure in the upstream part 649 exceeds a predetermined level, while at the same time, preventing such pressure loss as would cause the pressure in the upstream part 649 of the common portion 643 to fall below the predetermined level.

The third fluid line 641 also includes a first branch portion 651 which communicates with the upstream part 649 of the common portion 643 and, through a conduit 231A, with the second port 223 of the first hydraulic steering cylinder 211 of the first marine propulsion device 203. In addition, the third fluid line 641 includes a second branch portion 653 which communicates with the upstream part 649 of the common portion 643 and, through a conduit 231B with the first port 225 of the second hydraulic steering cylinder 213 of the second marine propulsion device 205.

The branch portions 651 and 653 provide an unrestricted hydraulic tie line equivalent to the tie line 231 between the second port 223 of the first steering cylinder 211 of the first marine propulsion device 203 and the first port 225 of the hydraulic steering cylinder 213 of the second marine propulsion device 205.

The control unit 611 further includes means, responsive to fluid under pressure in the upstream portion 625 of the first fluid line 621 and to fluid under pressure in the third fluid line 641 between the pressure relief valve 645 and the first and second steering cylinders 211 and 213, for communicating the downstream portion 637 of the second fluid line 631 with the downstream port 647 of the third line 641.

More particularly, in the disclosed construction, such means comprises a third one-way, normally closed check valve 655 which communicates with the upstream part 649 of the common portion 643 of the third fluid line 641 and which includes an outlet port 657. In addition, there is also provided means in the form of a first cylinder-piston assembly 661 communicating with the upstream portion 625 of the first fluid line 621 for opening the third check valve 655 in response to pressure fluid in the upstream portion 625 of the first fluid line 621, together with a fourth one-way, normally closed check valve 663 communicating between the downstream portion 637 of the second line 631 and the downstream portion 647 of the third line 641.

Still further in addition, there is provided means in the form of a second cylinder-piston assembly 665 communicating through a line 666 with the outlet port 657 of the third check valve 655 for opening the fourth check valve 663 in response to fluid flow from the third check valve outlet port 657.

Also provided are means responsive to fluid under pressure in the upstream portion 635 of the second fluid line 631 and to fluid under pressure in the third fluid line 641 between the pressure relief valve 645 and the steering cylinders 211 and 213 of the first and second marine propulsion devices 203 and 205 for communicating the downstream portion 627 of the first fluid line 621 with the downstream part 647 of the third line 641. In the disclosed construction, such means comprises a fifth one-way, normally closed check valve 667 which communicates with the upstream part 649 of the common portion 643 of the third fluid line 641 and which includes an outlet port 669, together with means in the form of a third cylinder-piston assembly 671 communicating with the upstream portion 635 of the second fluid line 631 for opening the fifth check valve 667 in response to fluid under pressure in the upstream portion 635 of the second fluid line 631. In addition, a sixth one-way, normally closed check valve 673 communicates between the downstream port 647 of the third line 641 and the downstream portion 627 of the first line 621. Still further in addition, there is provided means in the form of a fourth cylinder-piston assembly 675 communicating through a line 676 with the outlet port 669 of the fifth check valve 667 for opening the sixth check valve 673 in response to fluid flow from the fifth check valve outlet port 669.

Means are provided for venting excess pressure from the lines 666 and 676 so as to permit respective closing of the check valves 663 and 673 after prior closure of the check valves 655 and 667. Thus, pressure relief valves 668 and 678 communicate respectively between the lines 666 and 676 and the upstream portions 625 and 635 of the first and second lines 621 and 631 so as to respectively afford flow from the lines 666 and 676 to the upstream portions 625 and 635 of the first and second lines 621 and 631 when the check valves 655 and 667 are closed and when the pressure in the lines 666 and 676 is above the pressure normally permitting closure the check valves 663 and 673. It is noted that during steering operation, the force of the biasing spring in the pressure relief values 668 and 678 is augmented by the pressure of the fluid in the upstream portion of the lines 621 and 631 which is under pressure. However, when steering operation ceases, this augmentation is removed and only a relatively small pressure in the lines 666 and 676 will open the pressure relief valves 663 and 673.

The means operable, when the steerable propulsion units 207 and 209 are in nonangularly aligned steering positions, for locating the steerable propulsion units 207 and 209 in angularly aligned positions includes means for communicating excess pressure in the steering cylinders 211 and 213, or in the downstream portions 627 and 637 of the first and second fluid lines 621 and 631, to the upstream part 649 of the third line 641, i.e., to the hydraulic tie line consisting of the branch conduit portions 651 and 653 of the third fluid line 641, so as to counteract or overcome any negative pressure condition in either of the branch portions 651 and 653 of the third fluid line 641 or in the associated ends of the steering cylinders 211 and 213. Thus, in the illustrated construction, the control unit 611 also includes a second one-way pressure relief valve 681 which communicates between the downstream portion 627 of the first fluid line 621 and the upstream part 649 of the third fluid line 641, as well as a third one-way pressure relief valve 683 which communicates between the downstream portion 637 of the second fluid line 631 and the upstream part 649 of the third fluid line 641. Both the second and third pressure relief valves 681 and 683 are constructed so as to bleed excess pressures above a predetermined level from the downstream portions 627 and 637 of the associated fluid lines 621 and 631 to the upstream part 649 of the common portion 643 of the third fluid line 641, while maintaining a given pressure level in the associated fluid lines 621 and 631. Preferably, the pressure relief valves 681 and 683 maintain in the first and second fluid lines 621 and 631 approximately the same pressure level as maintained by the first pressure relief valve 645.

Desirably, the control unit 611 also includes additional or by-pass pressure relief means for venting the first and second fluid lines 621 and 631 to the sump 23. While various arrangements can be employed, in the illustrated construction, such means comprises a fourth one-way pressure relief valve 685 communicating between the downstream portion 627 of the first fluid line 621 and the downstream part 647 of the common portion 643 of the third fluid line 641, and a fifth one-way pressure relief valve 687 communicating between the downstream portion 637 of the second fluid line 631 and the downstream part 647 of the common portion 643 of the third fluid line 641. The fourth and fifth one-way pressure relief valves 685 and 687 are, as the first, second and third pressure relief valves 645, 681 and 683, regulating relief valves which bleed excess pressure, while maintaining a given pressure upstream of the valve. Preferably, the fourth and fifth pressure relief valves 685 and 687 are arranged to bleed off excess pressure above a pressure level which is greater than the pressure levels maintained by the second and third valves 681 and 683 but less than the sum of the pressure levels of the first relief valve 645 and one of the second and third relief valves 681 and 683.

In operation, actuation of the steering wheel 21 to deliver fluid under pressure through the first pump discharge port 17 into the first fluid line 621 causes delivery of fluid under pressure to the first port 221 of the steering cylinder 211 of the marine propulsion device 203, thereby causing counter-clockwise steering movement of the propulsion unit 207. Simultaneously, fluid under pressure is discharged through the second port 223 of the steering cylinder 221 of the first marine propulsion device 203 and flows through the branch portion 651 and 653 of the third fluid line 641 (i.e., through the hydraulic tie line 231) to the first port 225 of steering cylinder 213 of the second marine propulsion device 205, thereby causing counter-clockwise steering movement of the propulsion unit 209. Simultaneously, fluid under pressure is discharged from the second port 227 of the steering cylinder 213 of the second marine propulsion device 205 in order to afford counter-clockwise steering movement of the second marine propulsion device 205. Such discharge and flow to the sump 23 is afforded in response to opening of the third check valve 655 consequent to action of the first cylinder-piston assembly 661 in response to the presence of fluid under pressure in the upstream portion 625 of the first fluid line 621 and consequent to the presence in the upstream part 649 of the third fluid line 641 of fluid under pressure which flows through the third check valve 655 and causes operation of the second cylinder-piston assembly 665 to open the fourth check valve 663.

In the event that the pressure in the upstream part 649 of the third fluid line 641 is sub-normal, turning movement of the second propulsion unit 209 will not occur until such time as the pressure level in the upstream part 649 of the third fluid line 641 is brought up to normal. In this regard, fluid cannot be discharged from the second port 227 of the steering cylinder 213 of the second marine propulsion device 209 during a condition of sub-normal pressure in the upstream part 649 of the third fluid line 641 because such pressure would be ineffective to operate the second cylinder-piston assembly 655 so as to open the fourth check valve 663. Under such circumstances, and before turning movement of the second propulsion unit 209 occurs, discharge of fluid under pressure from the second port 223 of the steering cylinder 211 of the first marine propulsion device 203, in response to counter-clockwise turning movement of the first propulsion unit 207, will serve to raise the pressure of the fluid in the upstream part 649 of the third fluid line 641 to the normal pressure sufficient to open the fourth check valve 663 and thereby permit counter-clockwise steering movement of the second propulsion unit 209.

In the event the second propulsion unit 209 is advanced with respect to the first propulsion unit 207 in relation to counter-clockwise propulsion unit steering movement, the second propulsion unit 209 will reach its position of maximum travel prior to arrival of the first propulsion unit 207 at its position of maximum travel. Under these circumstances, when the second propulsion unit 209 can no longer turn in the clockwise direction, the steering cylinder 213 of the second marine propulsion device 205 will no longer accept additional hydraulic fluid, and pressure will build in the upstream part 649 of the third fluid line 641 until opening of the first pressure relief valve 645, thereby permitting continued movement of the first propulsion unit 207 to its position of maximum travel and so as thereby to locate the first and second marine propulsion units 207 and 209 in synchronized or angularly aligned positions.

In the event the second propulsion unit 209 is retarded with respect to the first propulsion unit 207 in relation to counter-clockwise propulsion unit steering movement, the first propulsion unit 207 will arrive at the position of maximum travel prior to arrival of the second propulsion unit 209 at its position of maximum travel, i.e., the second propulsion unit 209 will be spaced from its position of maximum travel. Under such circumstances, the second pressure relief valve 681 opens to permit flow of fluid under pressure to the second branch portion 653 of the third fluid line 641 and thereby to the first port 225 of the steering cylinder 213 of the second marine propulsion device unit 209, thereby causing continued movement of the second propulsion unit 209 to its position of maximum travel, and thereby bringing both propulsion units 207 and 209 into synchronized or angularly aligned positions.

It is noted that synchronization of the steering positions of the first and second marine propulsion devices 203 and 205 can be obtained without adversely affecting boat operation when the engine is operating in neutral. Thus, before shifting into gear, the operator can obtain synchronized locations of the propulsion units 207 and 209 by temporarily operating the steering system to turn both propulsion units 207 and 209 to either of their positions of maximum travel.

While the above operation has been explained only in respect to the delivery of fluid under pressure from the first pump discharge port 17, the system works in exactly the same manner to obtain clockwise steering movement in response to the delivery of fluid under pressure from the second pump discharge port 19.

Shown fragmentarily and diagrammatically in FIG. 9 is still another embodiment comprising an intergrated control unit 711 which incorporates the feature of the prior art valve assembly 53 and control unit 251, which which is adapted for interposition between a helm station 13, such is shown in FIG. 2, and a pair of marine propulsion units 203 and 205 such as shown in FIGS. 4 and 7, and which includes means operable, during the presence of fluid under pressure at one of the first and second discharge ports 17 and 19, and in response to the absence of fluid under pressure in the tie line, for preventing steering movement of the other of the first and second propulsion units 207 and 209, and means operable, when the steerable propulsion units 207 and 209 are in nonangularly aligned steering positions, for locating the steerable propulsion units 207 and 209 in angularly aligned positions.

More particularly, the control unit 711 shown in FIG. 9 is generally the same as the control unit 611 shown in FIG. 8 except that the one-way check valves 623 and 633 have been omitted and, instead, a shuttle valve arrangement such as disclosed in FIG. 3 is employed.

Still more particularly, the control unit 711 shown in FIG. 9, includes a first fluid line 713 having a normally closed, one-way check valve 715 which divides the first fluid line 713 into a downstream portion 717 communicating through the conduit 269 with the first port 221 of the first steering cylinder 211, and an upstream portion 729 having a common branch 721, a supply branch 723 including a downstream part 725 communicating with the common branch 721, and an upstream part 727 communicating through the conduit 79 with the first pump discharge port 17, and a return branch 729 including an upstream part 731 communicating with the common branch 721 and a downstream part 733 communicating through the conduit 87 with the sump 23 at the helm station 13 shown in FIG. 2.

The control unit 711 also includes a second fluid line 735 including a normally closed, second check valve 737 dividing the second line 735 into a downstream portion 739 communicating through the conduit 279 with the second port 227 of the second steering cylinder 213, and an upstream portion 741 having a common branch 743, a supply branch 745 including a downstream part 747 communicating with the common branch 743, and an upstream branch 749 communicating through the conduit 109 with the second pump discharge port 19, and a return branch 751 including an upstream part 753 communicating with the common branch 743 and a downstream part 733 which is formed in common with the downstream part 733 of the return branch 729 of the upstream portion of the first fluid line 713 and which communicates through the conduit 87 with the sump 23 at the helm station 13 shown in FIG. 2.

The control unit 711 also includes means responsive to fluid under pressure in the upstream portion 719 of the first line 713 for opening the second check valve 737 and means responsive to fluid under pressure in the upstream portion 741 of the second line 735 for opening the first check valve 715. While various arrangements can be employed, in the illustrated construction, such means comprises the arrangement which is shown in FIG. 8 and which also includes check valves 655 and 667 as well as cylinder-piston assemblies 661, 665, 671 and 675.

Means are also provided, with respect to each of the first and second fluid lines 713 and 735, for selectively and alternatively permitting fluid flow in one of the supply and return branches while preventing flow in the other of the supply and return branches. While various other arrangements could be employed, in the illustrated construction, such means includes a first shuttle valve 761 operable selectively, in a first mode and in response to fluid under pressure in the upstream part 727 of the first line supply branch 723, to permit fluid flow from the upstream part 727 to the downstream part 725 of the first line supply branch 723 and to prevent fluid flow in the first line return branch 729, and in a second mode and in response to the absence of fluid under pressure in the upstream part 727 of the first line supply branch 723, to permit fluid flow from the upstream part 731 to the downstream part 733 of the first line return branch 729, and to prevent fluid flow through the first line supply branch 723. Additionally, the means for selectively and alternately permitting fluid flow in the supply and return branches includes a second shuttle valve 763 operable, in a first mode and in response to fluid under pressure in the upstream part 749 of the second line supply branch 745, to permit fluid flow from the upstream part 749 to the downstream part 747 of the second line supply branch 745 and to prevent fluid flow in the second line return branch 751 and, in a second mode and in response to the absence of fluid under pressure in the upstream part 749 of the second line supply branch 745, to permit fluid flow from the upstream part 753 to the downstream part 733 of the second line return branch 751 and to prevent fluid flow through the second line supply branch 745.

In the illustrated construction, the shuttle valves 761 and 763 are located in a common cylinder 765 and respectively comprise first and second pistons 767 and 769 which are identically constructed, which are located in axially spaced relation in the cylinder 765, and which respectively include, at their remote ends, reduced diameter extensions 771 and 773 adapted respectively to engage the adjacent ends of the cylinder 765 so as to respectively locate the pistons 767 and 769 in positions so that the cylinder ends communicate with the upstream parts 727 and 749 of the supply branches 723 and 745 of the first and second lines 713 and 735 respectively, so that the downstream parts 725 and 747 of the supply branches 723 and 745 of the first and second fluid lines 713 and 735 are respectively closed by the pistons 765 and 767, and so that the upstream parts 731 and 753 of the return branches 729 and 751 of the first and second fluid line 713 and 735 communicate with the area 775 which is located within the cylinder 765 between the pistons 767 and 769 and which communicates with the downstream part 733 of the return branches 729 and 751 of the first and second fluid lines 713 and 735.

Preferably, as shown in FIG. 9, a biasing spring 777 is located in the cylinder 765 and between the pistons 767 and 769 so that, in the absence of fluid under pressure at one of the ends of the cylinder 765, the pistons 767 and 769 are located with the extensions 771 and 773 in engagement with the adjacent ends of the cylinder 765 so as thereby to prevent fluid flow in the supply branches 723 and 745 and to permit fluid flow in the return branches 729 and 751. As is apparent, the presence of fluid under pressure at one of the ends of the cylinder 765 will cause displacement of the adjacent one of the pistons 767 and 769 against the action of the spring 777 to close the adjacent one of the return branches 729 and 751 and to open the adjacent one of the supply branches 723 and 745.

Because the check valves 715 and 737 are biased closed in the absence of fluid under pressure in the common branches 721 and 743 of the first and second fluid lines 713 and 735, means are provided for relieving excessive pressure which may occur in the downstream portions 717 and 739 of the first and second fluid lines 713 and 735. While various arrangements can be employed, in the illustrated construction, such means comprises first and second pressure relief valves 781 and 783 which respectively communicate with the downstream portions 717 and 739 of the first and second fluid lines 713 and 735 and with a third common duct or line 733 which communicates through the central cylinder area 775, and through the conduit with the sump 23 at the helm station 13 shown in FIG. 2.

Figure 10:
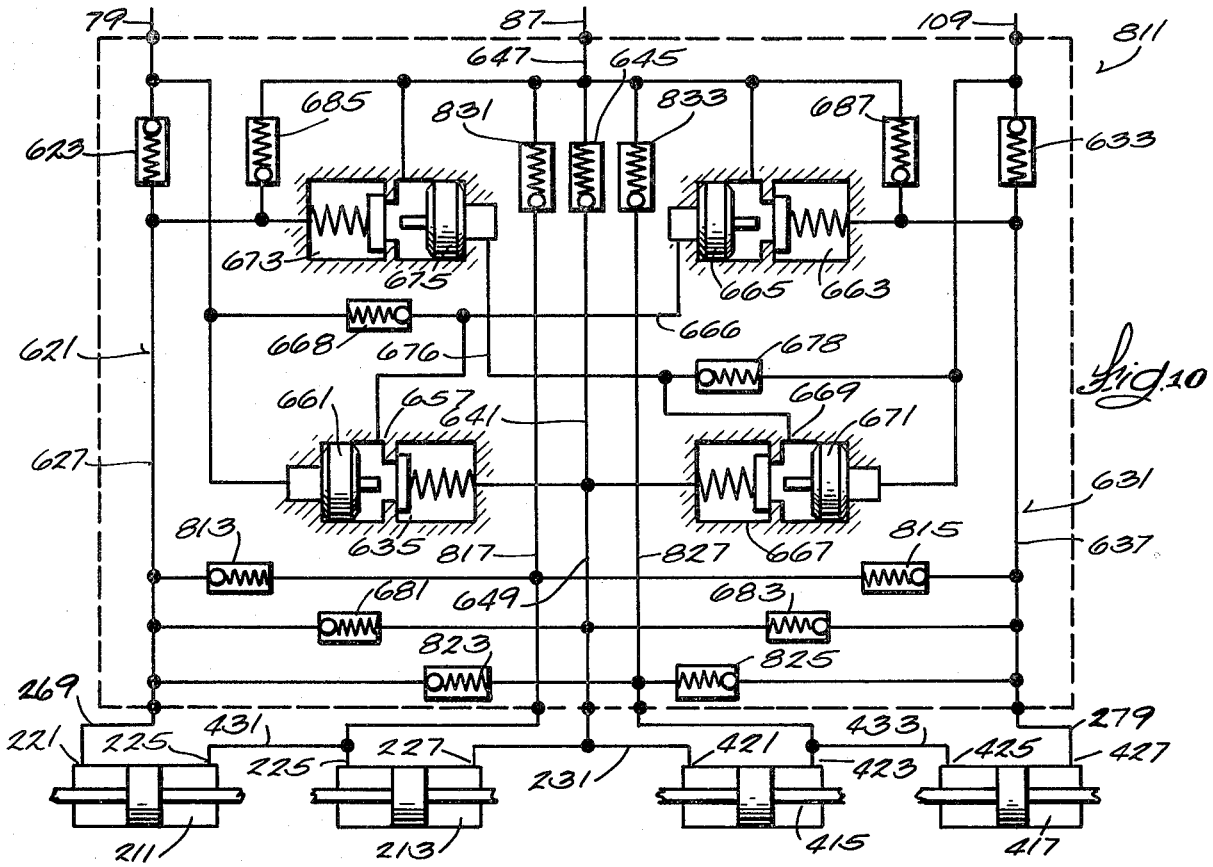
FIG. 10 is a fragmentary and diagrammatic view of a sixth marine propulsion installation incorporating various of the features of the invention.

Shown in FIG. 10 is still another embodiment comprising an integrated control unit 811 which is adapted for interposition between a helm station 13, such as shown in FIG. 2, and a plurality of marine propulsion devices 203, 205, 206, and 208 which, as shown in FIG. 6, include respective hydraulic steering cylinders 211, 213, 415, and 417. The control unit 811 is similar to the control unit 611 shown in FIG. 8, and includes means operable during the presence of fluid under pressure at one of the pump first and second discharge ports 17 and 19, and in response to the absence of fluid under pressure in one of the tie lines, for preventing steering movement of the other of the first and fourth marine propulsion devices 203 and 208, and means operable, when the steerable propulsion devices are in nonangularly aligned steering positions, for locating the steerable propulsion devices in angularly aligned positions. Accordingly, those components which are incorporated in the control unit 811 and which are similar to previously described components in the control unit 611 of FIG. 8 have been accorded the same reference numbers. In addition, the control unit 811 includes pressure relief valves 813 and 815 which are similar to the relief valves 441 and 443 incorporated in the control unit 413 shown in FIG. 6, and which communicate respectively with the downstream portions 627 and 637 of the first and second lines 621 and 631 and with a fluid line 817 which corresponds generally to the line 445 of the control unit 413 shown in FIG. 6, which constitutes a branch of the third line 641, and which communicates with the tie line 431 connecting the steering cylinders 211 and 213. The pressure relief valves 813 and 815 are regulating relief valves which bleed excess pressure, while maintaining a given pressure upstream of the valve.

In addition, the control unit 811 includes pressure relief valves 823 and 825 which are similar to the pressure relief valves 451 and 453 included in the control unit 413 shown in FIG. 6, and which communicates respectively with the downstream portions 627 and 637 of the first and second lines 621 and 631 and with a fluid line 827 which corresponds generally to the line 455 of the control unit 413 shown in FIG. 6, which constitutes a branch of the third line 641, and which communicates with the tie line 433 connecting the steering cylinders 415 and 417.

Still further in addition and in a manner similar to the incorporation of the relief valve 645 in the third line 641 in the control unit 611 of FIG. 8, the control unit 811 includes, in addition to the relief valve 645, relief valves 831 and 833 located respectively in the lines 817 and 827 which communicate respectively with the tie lines 431 and 433 and with the third line downstream portion 647 adapted to communicate through the conduit 87 with the sump 23 in the helm station 13 shown in FIG. 2. The pressure relief valves 831 and 833 are regulating relief valves which bleed excess pressure, while maintaining a given pressure upstream of the valve.

Figure 11:
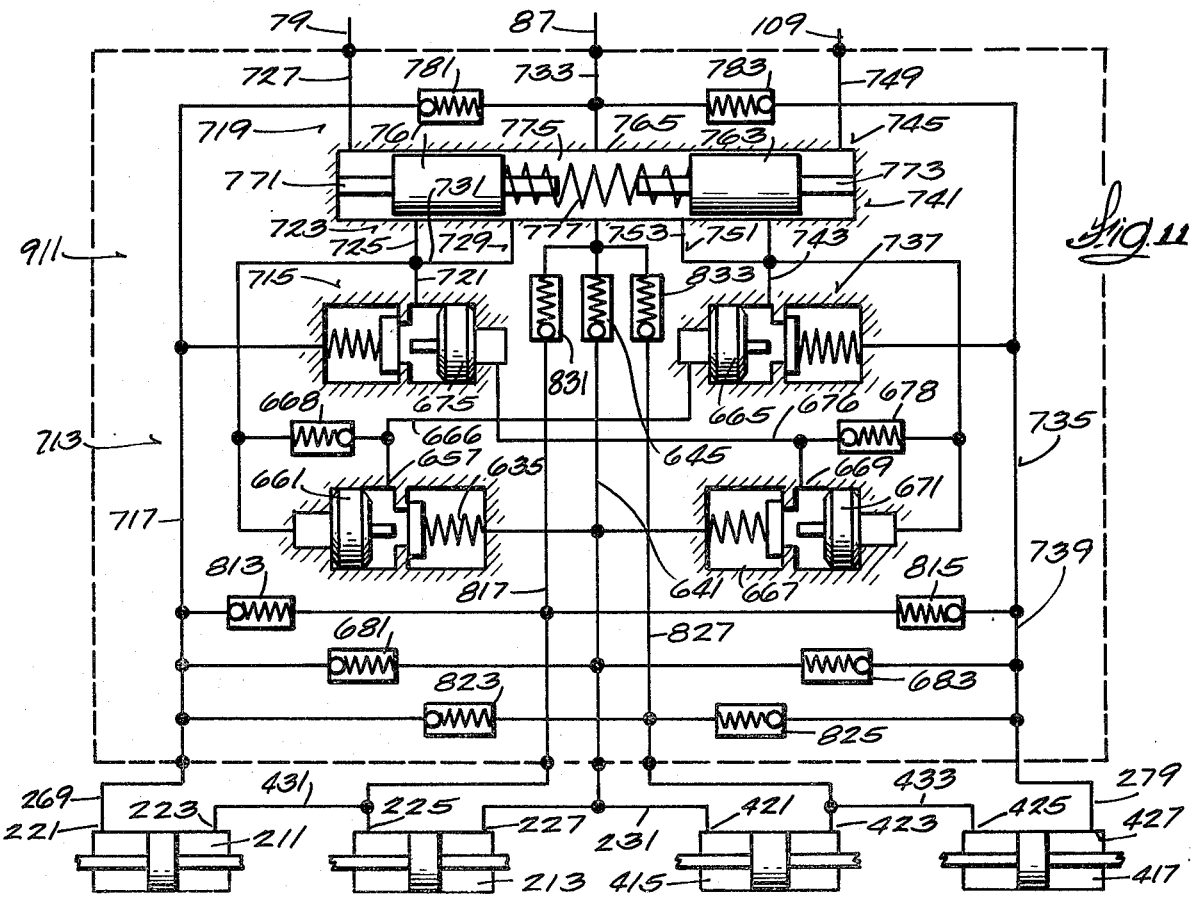
FIG. 11 is a fragmentary and diagrammatic view of a seventh marine propulsion installation incorporating various of the features of the invention.

Shown fragmentarily and schematically in FIG. 11 is still another embodiment comprising an integrated control unit 911 which is adapted for interposition between a helm station 13, such is shown in FIG. 2, and a plurality of four marine propulsion devices 203, 205, 206, and 208 such as shown in FIG. 6. The control unit 911 is similar, in part, to the control unit 811 of FIG. 10 and, in part, to the control unit 711 of FIG. 9, and also includes means operable, during the presence of fluid under pressure at one of the pump first and second discharge ports 17 and 19, and in response to the absence of fluid under pressure in one of the tie lines, for preventing steering movement of the other of the first and fourth propulsion units, and means operable, when the steerable propulsion devices are in nonangularly aligned steering positions, for locating the steerable propulsion devices in angularly aligned positions. Accordingly, those components which are incorporated in the control unit 911 and which are similar to previously described components of the control units 711 of FIG. 9 and 811 of FIG. 10 have been accorded the same reference numbers. It is noted that the normally closed one-way check valves 623 and 633 of the control unit 811 of FIG. 10 are omitted and that first and second lines 713 and 735 as in the control unit 711 of FIG. 9 are provided, as well as respective shuttle valves 761 and 763 arranged as explained in connection with the control unit 711 shown in FIG. 9.

In summary, there are provided control units which prevent movement of the downstream propulsion unit while there is an absence of pressure in a tie line and which, in the event one or more propulsion units are located in non-corresponding angular positions, serve to relocate the propulsion units in positions of corresponding angular location. The control units can be interposed between two or more propulsion units and a prior two-line helm station 13 as shown in FIG. 1, or between two or more propulsion units and a combined helm station and no-back steering valve assembly as shown in FIG. 2. Still further in addition, there are provided integrated control units for insertion between two or more propulsion units and a prior three-line helm station, such as shown in FIG. 2.

Various of the features of the invention are set forth in the following claims:

I claim:

1. A hydraulic control unit for a marine installation comprising a helm station including a pump comprising first and second pump discharge ports, and means for selectively and alternatively delivery fluid under pressure from the pump to the first and second pump discharge ports, first and second steerable marine propulsion units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, said hydraulic control unit including a first hydraulic fluid line adapted for communication between the first pump discharge port and the first steering cylinder first port, a second hydraulic fluid supply line adapted for communication between the second pump discharge port and the second steering cylinder second port, and means adapted for communication with the tie line and operably connected to each of said first and second fluid lines for preventing steering movement of one of the first and second propulsion units in response to the absence of fluid under presence in the tie line and during the presence in the other of said first and second fluid lines of fluid pressurized by the pump.

2. A hydraulic control unit in accordance with claim 1 wherein said first hydraulic fluid line includes a normally closed first check valve dividing said first line into an upstream portion adapted for communication with the first pump discharge port, and a downstream portion adapted for communication with the first steering cylinder first port, said first check valve opening in response to the presence of fluid under pressure in said upstream portion of said first line, wherein said second hydraulic fluid line includes a normally closed second check valve dividing said second line into an upstream portion adapted for communication with the second pump discharge port, and a downstream portion adapted for communication with the second steering cylinder second port, said second check valve opening in response to the presence of fluid under pressure in said upstream portion of said second line, and wherein said means for preventing steering movement of one of the first and second steerable units is operative selectively, in the absence of fluid under pressure in one of said first and second lines and in response to the presence of fluid under pressure in the tie line, for opening said check valve in said one of said first and second lines.

3. A hydraulic control unit in accordance with claim 2 wherein said means operative selectively for opening said check valve in said one of said first and second lines comprises first and second cylinder-piston assemblies respectively associated with said first and second check valves, each of said first and second cylinder-piston assemblies including a cylinder having one end adapted for communication with the tie line, and a piston movable in said cylinder and displaceable, in response to fluid under pressure in the tie line, so as to effect opening of the associated one of said check valves.

4. A hydraulic control unit in accordance with either of claims 1 and 2 and further including means adapted for communication with the tie line and operably connected with each of said first and second hydraulic fluid lines, and operable, when the steerable propulsion units are in nonangularly aligned steering positions, for locating the steerable propulsion units in angularly aligned positions.

5. A hydraulic control unit for a marine installation comprising a helm station including a pump comprising first and second pump discharge ports, and means for selectively and alternatively delivering fluid under pressure from the pump to the first and second pump discharge ports, first and second steerable marine propulsion units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, said hydraulic control unit including a first hydraulic fluid line adapted for communication between the first pump discharge port and the first steering cylinder first port, a second hydraulic fluid line adapted for communication between the second pump discharge port and the second steering cylinder second port, and means adapted for communication with the tie line and operably connected to each of said first and second fluid lines, and operable, during the presence of fluid under pressure in one of the first and second fluid lines, and in response to the absence of fluid under pressure in the tie line, for preventing steering movement of the other of the first and second propulsion units, and means adapted for communication with the tie line and operably connected to each of said first and second fluid lines and operable, when the steerable propulsion units are in nonangularly aligned steering positions, for locating the steerable propulsion units in angularly aligned positions, said means for locating the steerable propulsion units in angularly aligned positions comprising a third line adapted for communication with the tie line, a first pressure relief valve communicating between one of said first and second lines and said third line for permitting fluid flow from said one of said first and second lines to said third line when the pressure in said one of said first and second lines is above a predetermined value, and a second pressure relief valve communicating between said third line and said upstream portion of the other of said first and second lines when the pressure in said third line is above a predetermined value.

6. A hydraulic control unit in accordance with claim 5 wherein said means for locating the steerable propulsion units in angularly aligned positions further comprises a third pressure relief valve communicating between said other of said first and second lines and said third line for permitting fluid flow from said other of said first and second lines to said third line when the pressure in said other of said first and second lines is above a predetermined value, and a fourth pressure relief valve communicating between said third line and said upstream portion of said one of said first and second lines and permitting fluid flow from said third line to said upstream portion of said one of said first and second lines when the pressure in said third line is above a predetermined value.

7. A hydraulic control unit for a marine installation comprising a helm station including a pump comprising first and second pump discharge ports, a sump communicating with the pump, and means for selectively and alternatively delivering fluid under pressure from the pump to the first and second pump discharge ports, first and second steerable marine propulsion units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, said hydraulic control unit including a first hydraulic fluid line adapted for communication between the first pump discharge port and the first steering cylinder first port and including a normally closed first check valve dividing said first line into an upstream portion adapted for communication with the first pump discharge port, and a downstream portion adapted for communication with the first steering cylinder first port, said first check valve permitting flow of fluid under pressure from said upstream portion to said downstream portion and preventing fluid flow from said downstream portion to said upstream portion, a second hydraulic fluid line adapted for communication between the second pump discharge port and the second steering cylinder second port and including a normally closed second check valve dividing said second line into an upstream portion adapted for communication with the second pump discharge port, and a downstream portion adapted for communication with the second steering cylinder second port, said second check valve means permitting flow of fluid under pressure from said upstream portion to said downstream portion and preventing fluid flow from said downstream portion to said upstream portion, and means operable during the presence of fluid under pressure in one of the first and second fluid lines, and in response to the absence of fluid under pressure in the tie line, for preventing steering movement of the other of the first and second propulsion units, said means for preventing steering movement including a third hydraulic fluid line including a first pressure relief valve dividing said third fluid line into a downstream part adapted for communication with the sump and an upstream part adapted for communication with the tie line, and means responsive to fluid under pressure in said upstream portion of one of said first and second fluid lines and to fluid under pressure in said upstream part of said third fluid line for communicating said downstream portion of the other of said first and second fluid lines with said downstream part of said third fluid line.

8. A hydraulic control unit in accordance with claim 7 wherein said means responsive to fluid under pressure in said upstream portion of one of said first and second fluid lines and to fluid under pressure in said upstream part of said third fluid line for communicating said downstream portion of the other of said first and second fluid lines with said downstream part of said third fluid line comprises means responsive to fluid under pressure in said upstream portion of said first fluid line and to fluid under pressure in said upstream part of said third fluid line for communicating said downstream portion of said second fluid line with said downstream part of said third fluid line, and means responsive to fluid under pressure in said upstream portion of said second fluid line and to fluid under pressure in said upstream part of said third fluid line for communicating said downstream portion of said first fluid line with said downstream part of said third fluid line.

9. A hydraulic control unit in accordance with claim 8 wherein said means responsive to fluid under pressure in said upstream portion of said first fluid line and to fluid under pressure in said upstream part of said third fluid line for communicating said downstream portion of said second fluid line with said downstream part of said third fluid line comprises a third normally closed check valve communicating with said upstream part of said third fluid line and including an outlet port, means communicating with said upstream portion of said first fluid line for opening said third check valve in response to fluid under pressure in said upstream portion of said first fluid line, a fourth normally closed check valve communicating between said downstream part of said third fluid line and said downstream portion of said second fluid line, and means communicating with said outlet port of said third check valve for opening said fourth check valve in response to fluid flow from said third check valve outlet port, and wherein said means responsive to fluid under pressure in said upstream portion of said second fluid line and to fluid under pressure in said upstream part of said third fluid line for communicating said downstream portion of said first fluid line with said downstream part of said third fluid line comprises a fifth normally closed check valve communicating with said upstream part of said third fluid line and including an outlet port, means communicating with said upstream portion of said second fluid line for opening said fifth check valve in response to fluid under pressure in said upstream portion of said second fluid line, a sixth normally closed check valve communicating between said downstream part of said third fluid line and said downstream portion of said first fluid line, and means communicating with said outlet port of said fifth check valve for opening said sixth check valve means in response to fluid flow from said fifth check valve outlet port.

10. A hydraulic control unit in accordance with claim 7 and further including means adapted for communication between the first pump discharge port and the first steering cylinder first port and between the second pump discharge port and the second steering cylinder second port and with the tie line and operable, when the steerable propulsion units are in nonangularly aligned steering positions, for locating the steerable propulsion units in angularly aligned positions.

11. A hydraulic control unit in accordance with claim 10 wherein said means locating the steerable propulsion units in angularly aligned positions comprises a second pressure relief valve communicating between said downstream portion of said first fluid line and said upstream part of said third fluid line, and a third pressure relief valve communicating between said downstream portion of said second fluid line and said upstream part of said third fluid line.

12. A hydraulic control unit in accordance with claim 11 and further including a first by-pass pressure relief valve communicating between said downstream portion of said first fluid line and said downstream part of said third fluid line in by-passing relation to said second pressure relief valve, and a second by-pass pressure relief valve communicating between said downstream portion of said second fluid line and said downstream part of said third fluid line in by-passing relation to said third pressure relief valve.

13. A hydraulic control unit for a marine installation comprising a helm station including a pump comprising first and second pump discharge ports, and a sump communicating with the pump, and means for selectively and alternatively delivering fluid under pressure from the pump to the first and second pump discharge ports, first and second steerable marine propulsion units, first and second hydraulic steering cylinders respectively connected to the first and second propulsion units and including respective first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, said hydraulic control unit including means operable, during the presence of fluid under pressure supplied by the pump at one of the first steering cylinder first port and the second steering cylinder second port, and in response to the absence of fluid under pressure in the tie line, for preventing steering movement of the other of the first and second propulsion units, said means for preventing steering movement of the other of the first and second propulsion units including a first fluid line including a normally closed first check valve dividing said first line into a downstream portion adapted for communication with the first steering cylinder first port, and an upstream portion have a supply branch adapted for communication with the first pump discharge port, and a return branch adapted for communication with the sump, said first check valve opening in response to fluid under pressure in said first line supply branch, a second fluid line including a normally closed second check valve dividing said second line into a downstream portion adapted for communication with the second steering cylinder second port, and an upstream portion having a supply branch adapted for communication with the second pump discharge port, and a return branch adapted for communication with the sump, said second check valve opening in response to fluid under pressure in said second line supply branch, means adapted to be connected to the tie line and operative selectively, in the absence of fluid under pressure in one of said first and second lines and in response to the presence of fluid under pressure in the tie line, for opening said check valve in said one of said first and second lines, first means operable selectively, in a first mode and in response to fluid under pressure in said first line supply branch, to permit fluid flow through said first line supply branch and to prevent fluid flow through said first line return branch, and in a second mode and in response to the presence of fluid under pressure in said first line return branch, to permit fluid flow through said first line return branch and to prevent fluid flow through said first line supply branch, and second means operable selectively, in a first mode and in response to fluid under pressure in said second line supply branch, to permit fluid flow through said second line supply branch and to prevent fluid flow through said second line return branch, and in a second mode and in response to fluid under pressure in said second line return branch, to permit fluid flow through said second line return branch and to prevent fluid flow through said second line supply branch.

14. A hydraulic control unit in accordance with claim 13 wherein said upstream portion of said first line includes a common branch, wherein said first line supply branch includes an upstream part adapted for communication with the first pump discharge port and a downstream part communicating with said first line common branch, wherein said first line return branch includes an upstream part communicating with said first line common branch and a downstream part adapted for communication with the sump, wherein said upstream portion of said second line includes a common branch, wherein said second line supply branch includes an upstream part adapted for communicating with the second pump discharge port and a downstream part communicating with said second line common branch, wherein said second line return branch includes an upstream part communicating with said second line common branch and a downstream part adapted for communication with the sump, wherein said first means includes a first shuttle valve operable, in response to fluid under pressure in said upstream part of said first line supply branch, to permit fluid flow through said first line supply branch and to prevent fluid flow through said first line return branch and, in response to fluid under pressure in said upstream part of said first line return branch, to prevent fluid flow through said first line supply branch and to permit fluid flow through said first line return branch, and wherein said second means includes a second shuttle valve operable, in response to fluid under pressure in said upstream part of said second line supply branch, to permit fluid flow through said second line supply branch and to prevent fluid flow through said second line return branch and, in response to fluid under pressure in said upstream part of said second line return branch, to prevent fluid flow through said second line supply branch and to permit fluid flow through said second line return branch.

15. A hydraulic control unit in accordance with claim 13 and further including means adapted for communication between the first pump discharge port and the first steering cylinder first port and between the second pump discharge port and the second steering cylinder second port and with the tie line and operable, when the steerable propulsion units are in nonangularly aligned steering positions, for locating the steerable propulsion units in angularly aligned positions.

16. A hydraulic control unit in accordance with claim 15 wherein said means locating the steerable propulsion units in angularly aligned positions comprises a third line including a first pressure relief valve dividing said third line into an upstream portion adapted for communication with the tie line and a downstream portion adapted for communication with the sump, a second pressure relief valve permitting flow from said downstream portion of said first fluid line to said upstream portion of said third fluid line, and a third pressure relief valve permitting flow from said downstream portion of said second fluid line to said upstream portion of said third fluid line.

17. A hydraulic control unit in accordance with claim 16 and further including a first by-pass pressure relief valve communication between said downstream portion of said first fluid line and said downstream portion of said third line in by-passing relation to said second pressure relief valve, and a second by-pass pressure relief valve communicating between said downstream portion of said second fluid line and said downstream portion of said third fluid line in by-passing relation to said third pressure relief valve.

18. A hydraulic control unit for a marine propulsion installation comprising a helm station including a pump comprising first and second pump discharge ports, and means for selectively and alternatively delivering fluid under pressure from the pump to the first and second pump discharge ports, first and second steerable marine propulsion units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, and a hydraulic tie line connecting the second port of the first steering cylinder with the first port of the second steering cylinder, said hydraulic control unit including a first hydraulic fluid line adapted for communication between the first pump discharge port and the first steering cylinder first port and including a normally closed first check valve dividing said first line into an upstream portion adapted for communication with the first pump discharge port, and a downstream portion adapted for communication with the first steering cylinder first port, said first check valve opening in response to the presence of fluid under pressure in said upstream portion of said first line, a second hydraulic fluid line adapted for communication between the second pump discharge port and the second steering cylinder second port, and including a normally closed second check valve dividing said second line into an upstream portion adapted for communication with the second pump discharge port, and a downstream portion adapted for communication with the second steering cylinder second port, said second check valve opening in response to the presence of fluid under pressure in said upstream portion of said second line, and means adapted for communication with the tie line and lines, and operable, when the steerable propulsion units are in nonangularly aligned steering positions, for locating the steerable propulsion units in aligned angular positions, and comprising a third line adapted for communication with the tie line, a first pressure relief valve communicating between one of said first and second lines and said third line for permitting fluid flow from said one of said first and second lines to said third line when the pressure in said one of said first and second lines is above a predetermined value, and a second pressure relief valve communicating between said third line and said upstream portion of the other of said first and second lines and permitting fluid flow from said third line to said upstream portion of said other of said first and second lines when the pressure in said third line is above a predetermined value.

19. A hydraulic control unit in accordance with claim 18 wherein said means for locating the steerable propulsion units in angularly aligned positions further comprises a third pressure relief valve communicating between said other one of said first and second lines and said third line for permitting fluid flow from said other of said first and second lines to said third line when the pressure in said other of said first and second lines is above a predetermined value, and a fourth pressure relief valve communicating between said third line and said upstream portion of said one of said first and second lines and permitting fluid flow from said third line to said upstream portion of said one of said first and second lines when the pressure in said third line is above a predetermined value.

20. A hydraulic control unit for a marine installation comprising a helm station comprising a pump including first and second pump discharge ports, and means for selectively and alternatively delivering fluid under pressure from the pump to the first and second pump discharge ports, a plurality of steerable propulsion units, a corresponding plurality of hydraulic steering cylinders respectively connected to the each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, additional tie lines connecting successive steering cylinder second ports and the following steering cylinder first ports, said hydraulic control unit including a first hydraulic fluid line adapted for communication between the first pump discharge port and the first steering cylinder first port, a second hydraulic fluid line adapted for communication between the second pump discharge port and the last steering cylinder second port, and means adapted for communication with one of the tie lines and operably connected to said first and second fluid lines, and operable, during the presence of fluid under pressure supplied by the pump in one of the first and second fluid lines, and in response to the absence of fluid under pressure in the one tie line, for preventing steering movement of the other of the first and last propulsion units.

21. A hydraulic unit in accordance with claim 20 wherein said first fluid line includes a normally closed first check vavle dividing said first line into an upstream portion adapted for communication with the first pump discharge port, and a downstream portion adapted for communication with the first steering cylinder first port, said first check valve opening in response to the presence of fluid under pressure in said upstream portion of said first line, wherein said second fluid line includes a normally closed second check valve dividing said second line into an upstream portion adapted for communication with the second pump discharge port, and a downstream portion adapted for communication with the last steering cylinder second port, said second check valve opening in response to the presence of fluid under pressure in said upstream portion of said second line, and wherein said means for preventing steering movement of the other of the first and last propulsion units is operative selectively, in the absence of fluid under pressure in one of said first and second lines and in response to the presence of fluid under pressure in the one of the tie lines, for opening said check valve in said one of said first and second lines.

22. A hydraulic control unit in accordance with claim 21 wherein said means operative selectively for opening said check valve in said one of said first and second lines comprises first and second cylinders-piston assemblies respectively associated with said first and second check valves, each of said first and second cylinder-piston assemblies including a cylinder adapted at one end for communication with the one tie line and a piston movable in said cylinder and displaceable, in response to fluid under pressure in the one tie line, so as to effect opening of the associated one of said check valves.

23. A hydraulic control unit in accordance with either by claims 20 and 21 and further including means adapted for communication with one of the tie lines and operatively connected to each of the first and second fluid lines, and operable, when the steerable propulsion units are in nonangularly aligned steering positions, for locating the steerable propulsion units in angularly aligned positions.

24. A hydraulic control unit in accordance with claim 23 wherein said means for locating the steerable propulsion units in angularly aligned positions comprises a first plurality of pressure relief valves communicating with one of said first and second lines and respectively adapted for communication with each of said tie lines for permitting fluid flow from said one of said first and second lines to each of said tie lines when the pressure in said one of said first and second lines is above a predetermined value, and a second plurality of pressure relief valves respectively adapted for communication with the each of said tie lines and with said upstream portion of the other of said first and second lines and permitting fluid flow from each of said tie lines to said upstream portion of said other of said first and second lines when the pressure in each of said tie lines is above a predetermined value.

25. A hydraulic control unit for a marine installation comprising a helm station comprising a pump including first and second pump discharge ports, a sump communicating with the pump, and means for selectively and alternatively delivering fluid under pressure from the pump to the first and second pump discharge ports, a plurality of steerable propulsion units, a corresponding plurality of hydraulic steering cylinders respectively connected to each of said propulsion units and including respective first ports which, when subject to fluid under pressure, tend to steer the propulsion units in one direction, and including respective second ports which, when subject to fluid under pressure, tend to steer the propulsion units in the opposite direction, a first tie line connecting the first steering cylinder second port and the second steering cylinder first port, additional tie lines connecting successive steering cylinder second ports and the following steering cylinder first ports, said hydraulic control unit including a first hydraulic fluid line adapted for communication between the first pump discharge port and the first steering cylinder first port and including a normally closed first check valve dividing said first line into an upstream portion adapted for communication with the first pump discharge port, and a downstream portion adapted for communication with the first steering cylinder first port, said first check valve permitting flow of fluid under pressure from the first pump discharge port to the first steering cylinder first port and preventing fluid flow from the first steering cylinder first port to the first pump discharge port, a second hydraulic fluid line adapted for communication between the second pump discharge port and the last steering cylinder second port and including a normally closed second check valve dividing said second fluid line into an upstream portion adapted for communication with the second pump discharge port, and a downstream portion adapted for communication with the last steering cylinder second port, said second check valve permitting flow of fluid under pressure from the second pump discharge port to said last steering cylinder second port and preventing fluid flow from the last steering cylinder second port to the second pump discharge port, means operable, during the presence of fluid under pressure in one of the first and second fluid lines, and in response to the absence of fluid unde pressure in the one tie line, for preventing steering movement of the other of the first and last propulsion units, said means for preventing steering movement including, a third hydraulic fluid line adapted for communication with the sump and with one of the tie lines, means responsive to fluid under pressure in said upstream portion of said first fluid line and to fluid under pressure in said third fluid line for communicating said downstream portion of said second fluid line with the sump, and means responsive to fluid under pressure in said upstream portion of said second fluid line and to fluid under pressure in said third fluid line for communicating said downstream portion of said first fluid line with the sump.

26. A hydraulic control unit in accordance with claim 25 wherein said means responsive to fluid under pressure in said upstream portion of said first fluid line and to fluid under pressure in said third fluid line for communicating said downstream portion of said second fluid line with the sump comprises a third normally closed check valve communicating with said third fluid line and including an outlet port, means communicating with said upstream portion of said first fluid line for opening said third check valve in response to fluid under pressure in said upstream portion of said first fluid line, a fourth normally closed check valve adapted for communication between said sump and said downstream portion of said second fluid line, and means communicating with said outlet port of said third check valve for opening said fourth check valve in response to fluid flow from said third check valve outlet port, and wherein said means responsive to fluid under pressure in said upstream portion of said second fluid line and to fluid under pressure in said third fluid line for communicating said downstream portion of said first fluid line with the sump comprises a fifth normally closed check valve communicating with said third fluid line and including an outlet port, means communicating with said upstream portion of said second fluid line for opening said fifth check valve in response to fluid under pressure in said upstream portion of said second fluid line, a sixth normally closed check valve adapted for communication between the sump and said downstream portion of said first fluid line, and means communicating with said outlet port of said fifth check valve for opening said sixth check valve in response to fluid flow from said fifth check valve outlet port.

27. A hydraulic control unit in accordance with claim 25 and further including means adapted for communication between the first pump discharge port and the first steering cylinder first port and between the second pump discharge port and the last steering cylinder second port and with one of the tie lines and operable, when the propulsion units are in nonangularly aligned steering positions, for locating the propulsion units in angularly aligned positions.

28. A hydraulic control unit in accordance with claim 27 wherein said means for locating the steerable propulsion units in angularly aligned positions comprises formation of said third line with a common portion adapted for communication with the sump, a plurality of branch portions including a corresponding plurality of pressure relief valves dividing each of said branch portions into a downstream part communicating with said common portion and an upstream part adapted for communication with each of said tie lines.

29. A hydraulic control unit in accordance with claim 28 wherein said means for locating the steerable propulsion units in angularly aligned positions further includes a second plurality of pressure relief valves communicating between said downstream portion of said first fluid line and said upstream part of each of said branch portions of said third fluid line, and a third plurality of pressure relief valves communicating between said downstream portion of said second fluid line and said upstream part of each of said branch portions of said third fluid line.

30. A hydraulic unit for a marine installation comprising a helm station comprising a pump including first and second pump discharge ports, and a sump communicating with the pump, and means for selectively and alternatively delivering fluid under pressure from the pump to the first and second pump discharge ports, a plurality of steerable propulsion units, a corresponding plurality of hydraulic steering cylinders respectively connected to each of said propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port and the second steering cylinder first port, additional tie lines connecting successive steering cylinder second ports and the following steering cylinder first ports, said hydraulic control unit including means operable, in response to the absence of fluid under pressure in one of the tie lines, for preventing steering movement of the other of the first and last propulsion units, said means for preventing steering movement of the other of the first and last propulsion units including a first fluid line including a normally closed first check valve dividing said first line into a downstream portion adapted for communication with the first steering cylinder first port, and an upstream portion having a supply branch adapted for communication with the first pump discharge port, and a return branch adapted for communication with the sump, said first check valve opening in response to fluid under pressure in said first line supply branch, a second fluid line including a normally closed second check valve dividing said second line into a downstream portion adapted for communication with the last steering cylinder second port, and an upstream portion having a supply branch adapted for communication with the second pump discharge port, and a return branch adapted for communication with the sump, said second check valve opening in response to fluid under pressure in said second line supply branch, means adapted for communication with the one tie line and operative selectively, in the absence of fluid under pressure in one of said first and second lines and in response to the pressure of fluid under pressure in the one tie line, for opening said check valve in said one of said first and second lines.

31. A hydraulic control unit in accordance with claim 30 and further including first means operable selectively, in a first mode and in response to fluid under pressure in said first line supply branch, to permit fluid flow through said first line supply branch and to prevent fluid flow through said first line return branch, and in a second mode and in response to the presence of fluid under pressure in said first line return branch, to permit fluid flow through said first line return branch and to prevent fluid flow through said first line supply branch, and second means operable selectively, in a first mode in response to fluid under pressure in said second line supply branch, to permit fluid flow through said second line supply branch and to prevent fluid flow through said second line return branch, and in a second mode and in response to fluid under pressure in said second line return branch, to permit fluid flow through said second line return branch and to prevent fluid flow through said second line supply branch.

32. A hydraulic control unit in accordance with claim 31 wherein said upstream portion of said first line includes a common branch, wherein said first line supply branch includes an upstream part adapted for communication with the first pump discharge port and a downstream part communicating with said first line common branch, wherein said first line return branch includes an upstream part communicating with said first line common branch and a downstream part adapted for communication with the sump, wherein said upstream portion of said second line includes a common branch, wherein said second line supply branch includes an upstream part adapted for communication with the second pump discharge port and a downstream part communicating with said second line common branch, wherein said second line return branch includes an upstream part communicating with said second line common branch and a downstream part adapted for communication with the pump, wherein said first means includes a first shuttle valve operable, in response to fluid under pressure in said upstream part of said first line supply branch, to permit fluid flow through said first supply branch and to prevent flow through said first line return branch and, in response to fluid under pressure in said upstream part of said first line return branch, to prevent fluid flow through said first line supply branch and to permit fluid flow through said first line return branch, and wherein said second means includes a second shuttle valve operable, in response to fluid under pressure in said upstream part of said second line supply branch, to permit fluid flow through said second line supply branch and to prevent flow through said second line return branch and, in response to fluid under pressure in said upstream part of said second line return branch, to prevent fluid flow through said second line supply branch and to permit fluid flow through said second line return branch.

33. A hydraulic control unit in accordance with claim 30 and further including means adapted for communication between the first pump discharge port and the first steering cylinder first port and between the second pump discharge port and the last steering cylinder second port and with one of the tie lines and operable, when the steerable propulsion units are in nonangularly aligned steering positions, for locating the steerable propulsion units in angularly aligned positions.

34. A hydraulic control unit in accordance with claim 33 wherein said means for locating the steerable propulsion units in angularly aligned positions comprises a first plurality of pressure relief valves communicating with one of said first and second lines and respectively adated for communication with each of said tie lines for permitting fluid flow from said one of said first and second lines to each of said tie lines when the pressure in said one of said first and second lines is above a predetermined value, and a second plurality of pressure relief valves respectively adapted for communication, with each of said tie lines and communicating with said upstream portion of the other of said first and second lines for permitting fluid flow from each of said tie lines to said upstream portion of said other of said first and second lines when the pressure in each of said tie lines is above a predetermined value.

35. A hydraulic control unit for a marine propulsion installation comprising a helm station including a sump, a pump communicating with the sump and including first and second pump discharge ports, and means for selectively and alternatively delivering fluid under pressure from the pump to the first and second pump discharge ports, a plurality of steerable propulsion units, a corresponding plurality of hydraulic steering cylinders respectively connected to each of said steerable propulsion units and including respective first ports which, when subject to fluid under pressure, tend to steer the propulsion units in one direction and including respective second ports which, when subject to fluid under pressure, tend to steer the propulsion units in the opposite direction, a first tie line connecting the first steering cylinder second port with the second steering cylinder first port, and additional tie lines connecting successive steering cylinder second ports and the following steering cylinder first ports, said hydraulic control unit uncluding a first hydraulic fluid line adapted for communication between the first pump discharge port and the first steering cylinder first port and including a normally closed first check valve dividing said first line into an upstream portion adapted for communication with the first pump discharge port, and a downstream portion adapted for communication with the first steering cylinder first port, said first check valve opening in response to the presence of fluid under pressure in said upstream portion of said first line, a second hydraulic fluid line adapted for communication between the second pump discharge port and the second steering cylinder second port, and including a normally closed second check valve dividing said second line into an upstream portion adapted for communication with the second pump discharge port, and a downstream portion adapted for communication with the second steering cylinder second port, said second check valve opening in response to the presence of fluid under pressure in said upstream portion of said second line, and means adapted for communication with one of the tie lines and operably connected with each of said first and second fluid lines, and operable, when the steerable propulsion units are in nonangularly aligned steering positions, for locating the steerable propulsion units in aligned angular positions, and comprising a first plurality of pressure relieve valves communicating between one of said first and second lines and respectively adapted for communication with each of said tie lines for permitting fluid flow from said one of said first and second lines to each of said tie lines when the pressure in said one of said first and second lines is above a predetermined value, and a second plurality of pressure relief valves respectively adapted for communication with each of said tie lines and communicating with said upstream portion of the other of said first and second lines for permitting fluid flow from each of said tie lines to said upstream portion of said other of said first and second lines when the pressure in the each of said tie lines is above a predetermined value.

36. A hydraulic control unit for a marine installation comprising first and second steerable marine propulation units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, a hydraulic tie line connecting the second port of the first steering cylinder with the first port of the second steering cylinder, a helm station including a sump, a pump communicating with the sump and including first and second pump discharge ports, and means for selectively and alternatively delivering fluid under pressure from the pump to the first and second pump discharge ports, and a control valve including a first fluid line including a normally closed first check valve dividing the first line into a downstream portion, and an upstream portion having a supply branch communicating with the first pump discharge port, and a return branch communicating with the sump, the first check valve opening in response to fluid under pressure in the first line supply branch, a second fluid line including a normally closed second check valve dividing the second line into a downstream portion, and an upstream portion having a supply branch communicating with the second pump discharge port, and a return branch communicating with the sump, the second check valve opening in response to fluid under pressure in the second line supply branch, and means operative selectively, in the absence of fluid under pressure in one of the first and second lines and in response to the presence of fluid under pressure in the other of the first and second lines, for opening the check valve in the one of said first and second lines, said hydraulic control unit including a third fluid line including a normally closed third check valve dividing said third line into an upstream portion adapted for communication with the downstream portion of the first line, and a downstream portion adapted for communication with the first steering cylinder first port, said third check valve opening in response to the presence of fluid under pressure in said upstream portion of said third line, a fourth fluid line including a normally closed fourth check valve dividing said forth fluid line into an upstream portion adapted for communication with the downstream portion of the second line, and a downstream portion adapted for communication with the second steering cylinder second port, said fourth check valve opening in response to the presence of fluid under pressure in said upstream portion of said fourth line, and means adapted to be connected to the tie line and operative selectively, in the absence of fluid under pressure in one of said third and fourth lines and in response to the presence of fluid under pressure in the tie line, for opening said check valve in said one of said third and fourth lines.

37. A hydraulic control unit in accordance with claim 36 and further including means operable, when the steerable propulsion units are in nonangularly aligned steering positions, for locating the steerable propulsion units in aligned angular positions.

38. A hydraulic control unit in accordance with claim 37 wherein said means for locating the steerable propulsion units in angularly aligned positions comprises a fifth line adapted for communication with the tie line, a first pressure relief valve communicating between one of said third and fourth lines and said fifth line for permitting fluid from said one of said third and fourth lines to said fifth line when the pressure in said one of said third and fourth lines is above a predetermined value, and a second pressure relief valve communicating between said fifth line and said upstream portion of the other of said third and fourth lines and permitting fluid flow from said fifth line to said upstream portion of said other of said third and fourth lines when the pressure in said fifth line is above a predetermined value.

39. A hydraulic control unit in accordance with claim 38 wherein said means for locating the steerable propulsion units in angularly aligned positions further includes a third pressure relief valve communicating between said other of said third and fourth lines and said fifth line for permitting fluid flow from said other of said third and fourth lines to said fifth line when the pressure in said other of said third and fourth lines is above a predetermined value, and a fourth pressure relief valve communicating between said fifth line and said upstream portion of said one of said third and fourth lines and permitting fluid flow from said fifth line to said upstream portion of said one of said third and fourth lines when the pressure in said fifth line is above a predetermined value.

40. A hydraulic control unit for a marine installation comprising first and second marine propulsion units, first and second hydraulic steering cylinders respectively connected to the first and second propulsion units and including respective first ports which, when subject to fluid under pressure, tend to steer the propulsion units in one direction and including respective second ports which, when subject to fluid under pressure, tend to steer the propulsion units in the opposite direction, a hydraulic tie line connecting the second port of the first steering cylinder with the first port of the second steering cylinder, a helm station including a sump, a pump communicating with the sump and including first and second pump discharge ports, and means for selectively and alternatively delivering fluid under pressure from the pump to the first and second pump discharge ports, and a control valve including a first fluid line including a normally closed first check valve dividing the first line into a downstream portion and an upstream portion having a common branch, a supply branch including a downstream part communicating with the common branch and an upstream part communicating with the first pump discharge port, and a return branch including an upstream part communicating with the common branch and a downstream part communicating with the sump, the first check valve opening in response to the presence of fluid under pressure in the upstream portion of the first line, a second fluid line including a normally closed second check valve dividing the second line into a downstream portion and an upstream portion having a common branch, a supply branch including a downstream part communicating with the common branch and an upstream part communicating with the second pump discharge port, and a return branch including an upstream part communicating with the common branch and a downstream part communicating with the sump, the second check valve opening in response to the presence of fluid under pressure in said upstream portion of said second line, and means responsive to fluid under pressure in the upstream portion of the first line for opening the second check valve and responsive to fluid under pressure in said upstream portion of the second line for opening the first check valve means, a first shuttle valve operable selectively, in a first mode and in response to fluid under pressure in the upstream part of the first line supply branch, to permit fluid flow between the upstream and downstream parts of the first line supply branch and to prevent fluid flow through the first line return branch, and in a second mode and in response to the presence of fluid under pressure in the upstream part of said first line return branch, to permit fluid flow from the upstream part to the downstream part of the first line return branch and to prevent fluid flow through the first line supply branch, and a second shuttle valve operable selectively in a first mode and in response to fluid under pressure in the upstream part of the second line supply branch, to permit fluid flow between the upstream and downstream parts of the second line supply branch, and to prevent fluid flow through the second line return branch, and in a second mode and in response to fluid under pressure in said upstream part of the second line return branch, to permit fluid flow from the upstream part to the downstream part of the second line return branch and to prevent fluid flow through the second line supply branch, said hydraulic control unit including a third fluid line including a normally closed third check valve dividing said third line into an upstream portion adapted for communication with the downstream portion of the first line, and a downstream portion adapted for communication with the first steering cylinder first port, said third check valve opening in response to the presence of fluid under pressure in said upstream portion of said third line, a fourth fluid line including a normally closed fourth check valve dividing said fourth fluid line into an upstream portion adapted for communicating with the downstream portion of the second line, and a downstream portion adapted for communication with the second steering cylinder second port, said fourth check valve opening in response to the presence of fluid under pressure in said upstream portion of said fourth line, and means adapted to be connected to the tie line and operative selectively, in the absence of fluid under pressure in one of said third and fourth lines and in response to the presence of fluid under pressure in the tie line, for opening said check valve in said one of said third and fourth lines.

41. A marine installation comprising a helm station including a pump comprising first and second pump discharge ports, and means for selectively and alternatively delivering fluid under pressure from said pump to said first and second pump discharge ports, first and second steerable marine propulsion units, first and second hydraulic steering cylinders respectively connected to said first and second propulsion units and including respective first ports which, when subject to fluid underpressure, tend to steer said propulsion units in one direction and including respective second ports which, when subject to fluid under pressure, tend to steer said propulsion unit in the opposite direction, a hydraulic tie line connecting said second port of said first steering cylinder with said first port of said second steering cylinder, and a hydraulic control unit including a first hydraulic fluid line communicating between said pump first discharge port and said first steering cylinder first port, a second hydraulic fluid line communicating between said pump second discharge port and said second steering cylinder second port, and means communicable between said tie line and each of said first and second fluid lines and operable, during the presence of fluid under pressure supplied by said pump in one of said first and second fluid lines, and in response to the absence of fluid under pressure in said tie line, for preventing steering movement of the other of said first and second propulsion units.

42. A marine installation in accordance with claim 41 wherein said first hydraulic fluid line includes a normally closed first check valve dividing said first line into an upstream portion communicating with said first pump discharge port, and a downstream portion communiating with said first steering cylinder first port, said first check valve opening in response to the presence of fluid under pressure in said upstream portion of said first line, wherein said second hydraulic fluid line includes a normally closed second check valve dividing said second line into an upstream portion communicating with said second pump discharge port, and a downstream portion communicating with said second steering cylinder second port, said second check valve opening in response to the presence of fluid under pressure in said upstream portion of said second line, and wherein said means for preventing steering movement of the other of the first and second propulsion units is operative selectively, in the absence of fluid under pressure in one of said first and second lines and in response to the presence of fluid under pressure in said tie line, for opening said check valve in said one of said first and second lines.

43. A marine installation in accordance with claim 42 wherein said means operative selectively for opening said check valve in said one of said first and second lines comprises first and second cylinder-piston assemblies respectively associated with said first and second check valves, each of said first and second cylinder-piston assemblies including a cylinder having one end communicating with said tie line, and a piston movable in said cylinder and displaceable, in response to fluid under pressure in said tie line, so as to effect opening of the associated one of said check valves.

44. A marine installation in accordance with either one of claims 41 and 42 and further including means communicating with said tie line and operably connected to each of said first and second fluid lines, and operable, when said steerable propulsion units are in nonangularly aligned steering positions, for locating said steerable propulsion units in angularly aligned positions.

45. A marine installation in accordance with claim 44 wherein said means for locating said steerable propulsion units in aligned angular positions comprises a third line communicating with said tie line, a first pressure relief valve communicating between one of said first and second lines and said third line for permitting fluid flow from said one of said first and second lines to said third line when the pressure in said one of said first and second lines is above a predetermined value, and a second pressure relief valve communicating between said third line and said upstream portion of the other of said first and second lines and permitting fluid flow from said third line to said upstream portion of said other of said first and second lines when the pressure in said third line is above a predetermined value.

46. A marine installation in accordance with claim 47 wherein said means for locating said steerable propulsion units in angularly aligned positions further comprises a third pressure relief valve communicating between said other of said first and second lines and said third line for permitting fluid flow from said other of said first and second lines to said third line when the pressure in said other of said first and second lines is above a predetermined value, and a fourth pressure relief valve communicating between said third line and said upstream portion of said one of said first and second lines and permitting fluid flow from said third line to said upstream portion of said one of said first and second lines when the pressure in said third line is above a predetermined value.

47. A marine installation in accordance with claim 41 wherein said helm station includes a sump communicating with said pump and wherein said first hydraulic fluid line includes a normally closed first check valve dividing said first line into an upstream portion communicating withs said first pump discharge port, and a downstream portion communicating with said first steering cylinder first port, said first check valve permitting flow of fluid under pressure from said upstream portion to said downstream portion and preventing fluid flow from said downstream portion to said upstream portion, wherein said second hydraulic fluid line includes a normally closed second check valve dividing said second line into an upstream portion communicating with said second pump discharge port, and a downstream portion communicating with said second steering cylinder second port, said second check valve means permitting flow of fluid under pressure from said upstream portion to said downstream portion and preventing fluid flow from said downstream portion to said upstream portion, and wherein said means for preventing steering movement further includes a third hydraulic fluid line including a first pressure relief valve dividing said third fluid line into a downstream part communicating with said sump and an upstream part communicating with said tie line, and means responsive to fluid under pressure in said upstream portion of one of said first and second fluid lines and to fluid under pressure in said upstream part of said third fluid line for communicating said downsteam portion of the other of said first and second fluid lines with said downstream part of said third fluid line.

48. A marine installation in accordance with claim 47 wherein said means responsive to fluid under pressure in said upstream portion of one of said first and second fluid lines and to fluid under pressure in said upstream part of said third fluid line for communicating said downstream portion of the other of said first and second fluid lines with said downstream part of said third fluid line comprises means responsive to fluid under pressure in said upstream portion of said first fluid line and to fluid under pressure in said upstream part of said third fluid line for communicating said downstream portion of said second fluid line with said downstream part of said third fluid line, and means responsive to fluid under pressure in said upstream portion of said second fluid line and to fluid under pressure in said upstream part of said third fluid line for communicating said downstream portion of said first fluid line with said downstream part of said third fluid line.

49. A marine installation in accordance with claim 50 wherein said means responsive to fluid under pressure in said upstream portion of said first fluid line and to fluid under pressure in said upstream part of said third fluid line for communicating said downstream portion of said second fluid line with said downstream part of said third fluid line comprises a third normally closed check valve communicating with said upstream part of said third fluid line and including an outlet port, means communicating with said upstream portion of said first fluid line for opening said third check valve in response to fluid under pressure in said upstream portion of said first fluid line, a fourth normally closed check valve communicating between said downstream part of said third fluid line and said downstream portion of said second fluid line, and means communicating with said outlet port of said third check valve for opening said fourth check valve in response to fluid flow from said third check valve outlet port, and wherein said means responsive to fluid under pressure in said upstream portion of said second fluid line and to fluid under pressure in said upstream part of said third fluid line for communicating said downstream portion of said first fluid line with said downstream part of said third fluid line comprises a fifth normally closed check valve communicating with said upstream part of said third fluid line and including an outlet port, means communicating with said upstream portion of said second fluid line for opening said fifth check valve in response to fluid under pressure in said upstream portion of said second fluid line, a sixth normally closed check valve communicating between said downstream part of said third fluid line and said downstream portion of said first fluid line, and means communicating with said outlet port of said fifth check valve for opening said sixth check valve means in response to fluid flow from said fifth check valve outlet port.

50. A marine installation in accordance with claim 47 and further including means communicating with said tie line and operably connected to each of said first and second fluid lines, and operable, when said steerable propulsion units are in nonangularly aligned steering positions, for locating said steerable propulsion units in angularly aligned positions.

51. A marine installation in accordance with claim 50 wherein said means locating said steerable propulsion units in angularly aligned positions comprises a second pressure relief valve communicating between said downstream portion of said first fluid line and said upstream part of said third fluid line, and a third pressure relief valve communicating between said downstream portion of said second fluid line and said upstream part of said third fluid line.

52. A marine installation in accordance with claim 51 and further including a first by-pass pressure relief valve communicating between said downstream portion of said first fluid line and said downstream part of said third fluid line in by-passing relation to said second pressure relief valve, and a second by-pass pressure relief valve communicating between said downstream portion of said second fluid line and said downstream part of said third fluid line in by-passing relation to said third pressure relief valve.

53. A marine installation in accordance with claim 41 wherein said helm station includes a sump communicating with said pump and wherein said means for preventing movement of the other of said first and second propulsion units includes a first fluid line including a normally closed first check valve dividing said first line into a downstream portion communicating with said first steering cylinder first port, and an upstream portion having a supply branch communicating with said first pump discharge port, and a return branch communicating with said sump, said first check valve opening in response to fluid under pressure in said first line supply branch, a second fluid line including a normally closed second check valve dividing said second line into a downstream portion communicating with said second cylinder second port, and an upstream portion having a supply branch communicating with said second pump discharge port, and a return branch communicating with said sump, said second check valve opening in response to fluid under pressure in said second line supply branch, means communicating with said tie line and operative selectively, in the absence of fluid under pressure in one of said first and second lines and in response to the presence of fluid under pressure in said tie line, for opening said check valve in said one of said first and second lines, first means operable selectively, in a first mode and in response to fluid under pressure in said first line supply branch, to permit fluid flow through said first line supply branch and to prevent fluid flow through said first line return branch, and in a second mode and in response to the presence of fluid under pressure in said first line return branch, to permit fluid flow through said first line return branch and to prevent fluid flow through said first line supply branch, and second means operable selectively, in a first mode and in response to fluid under pressure in said second line supply branch, to permit fluid flow through said second line supply branch and to prevent fluid flow through said second line return branch, and in a second mode and in response to fluid under pressure in said second line return branch, to permit fluid flow through said second line return branch and to prevent fluid flow through said second line supply branch.

54. A marine installation in accordance with claim 53 wherein said upstream portion of said first line includes a common branch, wherein said first line supply branch includes an upstream part communicating with said first pump discharge port and a downstream part communicating with said first line common branch, wherein said first line return branch includes an upstream part communicating with said first line common branch and a downstream part communicating with said sump, wherein said upstream portion of said second line includes a common branch, wherein said second line supply branch includes an upstream part communicating with said second pump discharge port and a downstream part communicating with said second line common branch, wherein said second line return branch includes an upstream part communicating with said second line common branch and a downstream part communicating with said sump, wherein said first means includes a first shuttle valve operable, in response to fluid under pressure in said upstream part of said first line supply branch, to permit fluid flow through said first line supply branch and to prevent fluid flow through said first line return branch and, in response to fluid under pressure in said upstream part of said first line return branch, to prevent fluid flow through said first line supply branch and to permit fluid flow through said first line return branch, and wherein said second means includes a second shuttle valve operable, in response to fluid under pressure in said upstream part of said second line supply branch, to permit fluid flow through said second line supply branch and to prevent fluid flow through said second line return branch and, in response to fluid under pressure in said upstream part of said second line return branch, to prevent fluid flow through said second line supply branch and to permit fluid flow through said second line return branch.

55. A marine installation in accordance with claim 53 further including means communicating between said first pump discharge port and said first steering cylinder first port and between said second pump discharge port and said second steering cylinder second port and with said tie line and operable when said steerable propulsion units are in nonangularly aligned steering positions, for locating said steerable propulsion units in angularly aligned positions.

56. A marine installation in accordance with claim 55 wherein said means locating said steerable propulsion units in angularly aligned positions comprises a third line including a first pressure relief valve dividing said third line into an upstream portion communicating with said tie line and a downstream portion communicating with said pump, a second pressure relief valve communicating between said downstream portion of said first fluid line and said upstream portion of said third fluid line, and a third pressure relief valve communicating between said downstream portion of said second fluid line and said upstream portion of said third fluid line.

57. A marine installation in accordance with claim 56 and further including a first by-pass pressure relief valve communicating between said downstream portion of said first fluid line and said downstream portion of said third fluid line in by-passing relation to said second pressure relief valve, and a second by-pass relief valve communicating between said downstream portion of said second fluid line and said downstream portion of said third fluid line in by-passing relation to said third pressure relief valve.

58. A marine propulsion installation comprising a helm station including a pump comprising first and second pump discharge ports, and means for selectively and alternatively delivering fluid under pressure from the pump to said first and second pump discharge ports, first and second steerable marine propulsion units, first and second steerable marine propulsion units, first and second hydraulic steering cylinders respectively connected to said first and second propulsion units and including respective first ports which, when subject to fluid under pressure, tend to steer said propulsion units in one direction and including respective second ports which, when subject to fluid under pressure, tend to steer the propulsion units in the opposite direction, a hydraulic tie line connecting said second port of said first steering cylinder with said first port of said second steering cylinder, and a hydraulic control unit including a first hydraulic fluid line communicating between said first pump discharge port and said first steering cylinder first port and including a normally closed first check valve dividing said first line into an upstream portion communicating with said first steering cylinder first port, said first check valve opening in response to the presence of fluid under pressure in said upstream portion of said first line, a second hydraulic fluid line communicating between said second pump discharge port and said second steering cylinder second port, and including a normally closed second check valve dividing said second line into an upstream portion communicating with said second pump discharge port, and a downstream portion communicating with said second steering cylinder second port, said second check valve opening in response to the presence of fluid under pressure in said upstream portion of said second line, and means communicating with said tie line and operably connected to each of said first and second fluid lines, and operable when said steerable propulsion units are in nonangularly aligned steering positions, for locating said steerable propulsion units in aligned angular positions, and comprising a third line communicating with said tie line, a first pressure relief valve communicating between one of said first and second lines and said third line for permitting fluid flow from said one of said first and second lines to said third line when the pressue in said one of said first and second lines is above a predetermined value, and a second pressure relief valve communicating between said third line and said upstream portion of the other of said first and second lines and permitting fluid flow from said third line to said upstream portion of said other of said first and second lines when the pressure in said third line is above a predetermined value.

59. A marine installation in accordance with claim 58 wherein said means for locating said steerable propulsion units in angularly aligned positions further comprises a third pressure relief valve communicating between said other one of said first and second lines and said third line for permitting fluid flow from said other of said first and second lines to said third line when the pressure in said other of said first and second lines is above a predetermined value, and a fourth pressure relief valve communicating between said third line and said upstream portion of said one of said first and second lines and permitting fluid flow from said third line to said upstream portion of said one of said first and second lines when the pressure in said third line is above a predetermined value.

60. A marine installation comprising a helm station comprising a pump including first and second pump discharge ports, and means for selectively and alternatively delivering fluid under pressure from said pump to said first and second pump discharge ports, a plurality of steerable propulsion units, a corresponding plurality of hydraulic steering cylinders respectively connected to each of said steerable propulsion units and including respective first ports which, when subject to fluid under pressure, tend to steer said propulsion units in one direction and including respective second ports which, when subject to fluid under pressure, tend to steer said propulsion units in the opposite direction, a first tie line connecting a first steering cylinder second port and a second steering cylinder first port, additional tie lines connecting successive steering cylinder second ports and the following steering cylinder first ports, and a hydraulic control unit including a first hydraulic fluid line communicating between said first pump discharge port and said first steering cylinder first port, a second hydraulic fluid line communicating between said second pump discharge port and the last steering cylinder second port, and means communicating with one of said tie lines and operably connected to said first and second fluid lines, and operable, during the presence of fluid under pressure supplied by said pump in one of the first and second fluid lines, and in response to the absence of fluid under pressure in said one tie line, for preventing steering movement of the other of the first and last propulsion units.

61. A marine installation in accordance with claim 60 wherein said first fluid line includes a normally closed first check valve dividing said first line into an upstream portion communicating with said first pump discharge port, and a downstream portion communicating with said first steering cylinder first port, said first check valve opening in response to the presence of fluid under pressure in said upstream portion of said first line, wherein said second fluid line includes a normally closed second check valve dividing said second line into an upstream portion communicating with said second pump discharge port, and a downstream portion communicating with said last steering cylinder second port, said second check valve opening in response to the presence of fluid under pressure in said upstream portion of said second line, and wherein said means for preventing steering movement is operative selectively, in the absence of fluid under pressure in one of said first and second lines and in response to the presence of fluid under pressure in said one of said tie lines, for opening said check valve in said one of said first and second lines.

62. A marine installation in accordance with claim 61 wherein said means operative selectively for opening said check valve in said one of said first and second lines comprises first and second cylinder-piston assemblies respectively associated with said first and second check valves, each of said first and second control cylinder-piston assemblies including a cylinder communicating at one end with said one tie line and a piston movable in said cylinder and displaceable, in response to fluid under pressure in said one tie line, so as to effect opening of the associated one of said check valves.

63. A marine installation in accordance with either of claims 60 and 61 and further including means communicating with one of said tie lines and operably connected to each of said first and second fluid lines, and operable, when said steerable propulsion units are located in nonangularly aligned steering positions, for locating said steerable propulsion units in angularly aligned positions.

64. A marine installation in accordance with claim 63 wherein said means for locating said steerable propulsion units in angularly aligned positions comprises a first plurality of pressure relief valves communicating with one of said first and second lines and respectively with each of said tie lines for permitting fluid flow from said one of said first and second lines to each of said tie lines when the pressure in said one of said first and second lines is above a predetermined value, and a second plurality of pressure relief valves communicating respectively with each of said tie lines and with said upstream portion of the other of said first and second lines and permitting fluid flow from each of said tie lines to said upstream portion of said other of said first and second lines when the pressure in each of said tie lines is above a predetermined value.

65. A marine installation in accordance with claim 60 wherein said helm station includes a sump communicating with said pump and wherein said means for preventing steering movement of the other of said first and last propulsion units includes a first hydraulic fluid line including a normally closed first check valve dividing said first line into an upstream portion communicating with said first pump discharge port, and a downstream portion communicating with said first steering cylinder first port, said first check valve permitting flow of fluid under pressure from said first pump discharge port to said first steering cylinder first port and preventing fluid flow from said first steering cylinder first port to said first pump discharge port, a second hydraulic fluid line including a normally closed second check valve dividing said second fluid line into an upstream portion communicating with said second pump discharge port, and a downstream portion communicating with said last steering cylinder second port, said second check valve permitting flow of fluid under pressure from said second pump discharge port to said last steering cylinder second port and preventing fluid flow from said last steering cylinder second port to said second pump discharge port, a third hydraulic fluid line communicating with said sump and with one of said tie lines, means responsive to fluid under pressure in said upstream portion of said first fluid line and to fluid under pressure in said third fluid line for communicating said downstream portion of said second fluid line with said sump, and means responsive to fluid under pressure in said upstream portion of said second fluid line and to fluid under pressure in said third fluid line for communicating said downstream portion of said first fluid line with said sump.

66. A marine installation in accordance with claim 65 wherein said means responsive to fluid under pressure in said upstream portion of said first fluid line and to fluid under pressure in said third fluid line for communicating said downstream portion of said second fluid line with said sump comprises a third normally closed check valve communicating with said third fluid line and including an outlet port, means communicating with said upstream portion of said first fluid line for opening said third check valve in response to fluid under pressure in said upstream portion of said first fluid line, a fourth normally closed check valve communicating between said sump and said downstream portion of said second fluid line, and means communicating with said outlet port of said third check valve for opening said fourth check valve in response to fluid flow from said third check valve outlet port, and wherein said means responsive to fluid under pressure in said upstream portion of said second fluid line and to fluid under pressure in said third fluid line for communicating said downstream portion of said first fluid line with said sump comprises a fifth normally closed check valve communicating with said third fluid line and including an outlet port, means communicating with said upstream portion of said second fluid line for opening said fifth check valve in response to fluid under pressure in said upstream portion of said second fluid line, a sixth normally closed check valve communicating between said sump and said downstream portion of said first fluid line, and means communicating with said outlet port of said fifth check valve for opening said sixth check valve in response to fluid flow from said fifth check valve outlet port.

67. A marine installation in accordance with claim 65 and further including means communicating between said first pump discharge port and said first steering cylinder first port and between said second pump discharge port and said last steering cylinder second port and with one of said tie lines and operable, when said propulsion units are in nonangularly aligned steering positions, for locating said propulsion units in angularly aligned positions.

68. A marine installation in accordance with claim 67 wherein said means for locating said steerable propulsion units in angularly aligned positions comprises formation of said third line with a common portion communicating with said sump, a first branch portion including a first pressure relief valve dividing said first branch into a downstream part communicating with said common portion and an upstream part communicating with said first tie line, additional branch portions including a first plurality of pressure relief valves dividing each of said branch portions into a downstream part communicating with said common portion and an upstream part communicating with each corresponding tie line.

69. A marine installation in accordance with claim 68 wherein said means for locating said steerable propulsion units in angularly aligned positions further includes a second plurality of pressure relief valves communicating between said downstream portion of said first fluid line and said upstream part of each of said branch portions of said third fluid line, a third plurality of pressure relief valves communicating between said downstream portion of said second fluid line and said upstream part of each of said first branch portions of said third fluid line.

70. A marine installation in accordance with claim 60 wherein the helm station includes a sump communicating with said pump and wherein said means for preventing steering movement of the other of the first and last propulsion units includes a first fluid line including a normally closed first check valve dividing said first line into a downstream portion communicating with said first steering cylinder first port, and an upstream portion having a supply branch communicating with said first pump discharge port, and a return branch communicating with said sump, said first check valve opening in response to fluid under pressure in said first line supply branch, a second fluid line including a normally closed second check valve dividing said second line into a downstream portion communicating with said last steering cylinder second port, and an upstream portion having a supply branch communicating with said second pump discharge port, and a return branch communicating with said sump, said second check valve opening in response to fluid under pressure in said second line supply branch, means communicating with one of said tie lines and operative selectively, in the absence of fluid under pressure in one of said first and second lines and in response to the presence of fluid under pressure in said one of said tie lines, for opening said check valve in said one of said first and second lines.

71. A marine installation in accordance with claim 70 and further including first means operable selectively, in a first mode and in response to fluid under pressure in said first line supply branch, to permit fluid flow through said first line supply branch and to prevent fluid flow through said first line return branch, and in a second mode and in response to the presence of fluid under pressure in said first line return branch, to permit fluid flow through said first line return branch and to prevent fluid flow through said first line supply branch, and second means operable selectively, in a first mode in response to fluid under pressure in said second line supply branch, to permit fluid flow through said second line supply branch and to prevent fluid flow through said second line return branch, and in a second mode and in response to fluid under pressure in said second line return branch, to permit fluid flow through said second line return branch and to prevent fluid flow through said second line supply branch.

72. A marine installation in accordance with claim 71 wherein said upstream portion of said first line includes a common branch, wherein said first line supply branch includes an upstream part communicating with said first pump discharge port and a downstream part communicating with said first line common branch, wherein said first line return branch includes an upstream part communicating with said first line common branch and a downstream part communicating with said sump, wherein said upstream portion of said second line includes a common branch, wherein said second line supply branch includes an upstream part communicating with said second pump discharge port and a downstream part communicating with said second line common branch, wherein said second line return branch includes an upstream part communicating with said second line common branch and a downstream part communicating with said sump, wherein said first means includes a first shuttle valve operable, in response to fluid under pressure in said upstream part of said first line supply branch, to permit fluid flow through said first supply branch and to prevent flow through said first line return branch and, in response to fluid under pressure in said upstream part of said firt line return branch, to prevent fluid flow through said first line supply branch and to permit fluid flow through said first line return branch, and wherein said second means includes a second shuttle valve operable, in response to fluid under pressure in said upstream part of said second line supply branch, to permit fluid flow through said second line supply branch and to prevent flow through said second line return branch and, in response to fluid under pressure in said upstream part of said second line return branch, to prevent fluid flow through said second line supply branch and to permit fluid flow through said second line return branch.

73. A marine installation in accordance with claim 70 and further including means communicating between said first pump discharge port and said first steering cylinder first port and between said second pump discharge port and said last steering cylinder second port and with one of said tie lines and operable, when said steerable propulsion units are in nonangularly aligned steering positions, for locating said steerable propulsion units in angularly aligned positions.

74. A marine installation in accordance with claim 73 wherein said means for locating said steerable propulsion units in angularly aligned positions comprises a first plurality of pressure relief valves communicating with one of said first and second lines and respectively with each of said tie lines for permitting fluid flow from said one of said first and second lines to each of said tie lines when the pressure in said one of said first and second lines is above a predetermined value, and a second plurality of pressure relief valves communicating respectively with each of said tie lines and with said upstream portion of the other of said first and second lines for permitting fluid flow from each of said tie lines to said upstream portion of said other of said first and second lines when the pressure in each of said tie lines is above a predetermined value.

75. A marine installation comprising a helm station including a sump, a pump communicating with said sump and including first and second pump discharge ports, and means for selectively and alternatively delivering fluid under pressure from said pump to said first and second pump discharge ports, a plurality of steerable propulsion units, a corresponding plurality of hydraulic steering cylinders respectively connected to each of said steerable propulsion units and including respective first ports which, when subject to fluid under pressure, then to steer said propulsion units in one direction and including respective second ports which, when subject to fluid under pressure, tend to steer said propulsion units in the opposite direction, a first tie line connecting said first steering cylinder second port when said second steering cylinder first port, additional tie lines connecting successive steering cylinder second ports to following steering cylinder first ports and a hydraulic control unit including a first hydraulic fluid line communicating between said first pump discharge port and said first steering cylinder first port and including a normally closed first check valve dividing said first line into an upstream portion communicating with said first pump discharge port, and a downstream portion communicating with said first steering cylinder first port, said first check valve opening in response to the presence of fluid under pressure in said upstream portion of said first line, a second hydraulic fluid line communicating between said second pump discharge port and said second steering cylinder second port, and including a normally closed second check valve dividing said second line into an upstream portion communicating with said second pump discharge port, and a downstream portion communicating with said second steering cylinder second port, said second check valve opening in response to the presence of fluid under pressure in said upstream portion of said second line, and means communicating with one of said lines and operably connected with each of said first and second fluid lines, and operable, when said steerable propulsion units are in nonangularly aligned steering positions, for locating said steerable propulsion units in aligned angular positions, and comprising a first plurality of pressure relief valves communicating between one of said first and second lines and respectively communicating with each of said tie lines for permitting fluid flow from said one to said first and second lines to each of said tie lines when the pressure in said one of said first and second lines is above a predetermined value, and a second plurality of pressure relief valves respectively communicating with each of said tie lines and communicating with said upstream portion of the other of said first and second lines for permitting fluid flow from each of said tie lines to said upstream portion of said other of said first and second lines when the pressure in each of said tie lines is above a predetermined value.

* * * * *